US011074863B2

(12) United States Patent
Chaji

(10) Patent No.: US 11,074,863 B2
(45) Date of Patent: Jul. 27, 2021

(54) PIXEL CIRCUITS FOR AMOLED DISPLAYS

(71) Applicant: Ignis Innovation Inc., Waterloo (CA)
(72) Inventor: Gholamreza Chaji, Waterloo (CA)
(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 17/020,970
(22) Filed: Sep. 15, 2020
(65) Prior Publication Data
US 2021/0005140 A1 Jan. 7, 2021

Related U.S. Application Data

(63) Continuation of application No. 16/585,458, filed on Sep. 27, 2019, now Pat. No. 10,810,940, which is a continuation of application No. 16/386,399, filed on Apr. 17, 2019, now Pat. No. 10,467,963, which is a continuation of application No. 15/979,848, filed on May 15, 2018, now Pat. No. 10,311,790, which is a
(Continued)

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2300/0819* (2013.01); *G09G 2300/0842* (2013.01); *G09G 2300/0861* (2013.01); *G09G 2320/0295* (2013.01); *G09G 2320/043* (2013.01); *G09G 2320/045* (2013.01);
(Continued)

(58) Field of Classification Search
CPC .. G09G 3/3233; G09G 3/3258; G09G 3/3266; G09G 3/3291; G09G 3/325; G09G 2320/10; G09G 2320/0295; G09G 2320/0693; G09G 2320/045; G09G 2300/0861; G09G 2300/0842; G09G 2300/0819; G09G 2330/08; G09G 2330/10; H05B 47/10
See application file for complete search history.

(56) References Cited

U.S. PATENT DOCUMENTS 7,053,875 B2 * 5/2006 Chou ..... G09G 3/325 345/214
8,194,063 B2 * 6/2012 Levey ..... G09G 3/3208 345/211
(Continued)

*Primary Examiner* — Haissa Philogene
(74) *Attorney, Agent, or Firm* — Stratford Managers Corporation

(57) ABSTRACT

A system for controlling a display in which each pixel circuit comprises a light-emitting device, a drive transistor, a storage capacitor, a reference voltage source, and a programming voltage source. The storage capacitor stores a voltage equal to the difference between the reference voltage and the programming voltage, and a controller supplies a programming voltage that is a calibrated voltage for a known target current, reads the actual current passing through the drive transistor to a monitor line, turns off the light emitting device while modifying the calibrated voltage to make the current supplied through the drive transistor substantially the same as the target current, modifies the calibrated voltage to make the current supplied through the drive transistor substantially the same as the target current, and determines a current corresponding to the modified calibrated voltage based on predetermined current-voltage characteristics of the drive transistor.

20 Claims, 34 Drawing Sheets

Related U.S. Application Data continuation of application No. 15/601,146, filed on May 22, 2017, now Pat. No. 9,997,106, which is a continuation of application No. 15/096,501, filed on Apr. 12, 2016, now Pat. No. 9,685,114, said application No. 14/298,333 is a continuation-in-part of application No. 14/363,379, filed as application No. PCT/IB2013/060755 on Dec. 9, 2013, now Pat. No. 9,978,310, said application No. 15/096,501 is a continuation-in-part of application No. 14/298,333, filed on Jun. 6, 2014, now Pat. No. 9,336,717, which is a continuation-in-part of application No. 13/710,872, filed on Dec. 11, 2012, now Pat. No. 9,786,223.

(60) Provisional application No. 61/815,698, filed on Apr. 24, 2013.

(52) U.S. Cl.
CPC . *G09G 2320/0693* (2013.01); *G09G 2320/10* (2013.01); *G09G 2330/08* (2013.01); *G09G 2330/10* (2013.01)

(56) References Cited

U.S. PATENT DOCUMENTS

| | | | | |
|---|---|---|---|---|
| 9,129,554 | B2 * | 9/2015 | Kim | G09G 3/32 |
| 9,275,579 | B2 * | 3/2016 | Chaji | G09G 3/3258 |
| 9,280,933 | B2 * | 3/2016 | Chaji | G09G 3/3241 |
| 9,336,717 | B2 * | 5/2016 | Chaji | G09G 3/3266 |
| 9,370,075 | B2 * | 6/2016 | Chaji | G09G 3/3291 |
| 9,412,305 | B2 * | 8/2016 | Lee | G09G 3/3266 |
| 9,530,349 | B2 * | 12/2016 | Chaji | G09G 3/3258 |
| 9,685,114 | B2 * | 6/2017 | Chaji | G09G 3/3233 |
| 9,786,223 | B2 * | 10/2017 | Chaji | G09G 3/3258 |
| 9,978,310 | B2 * | 5/2018 | Chaji | G09G 3/3258 |
| 9,997,106 | B2 * | 6/2018 | Chaji | G09G 3/3266 |
| 10,147,357 | B2 * | 12/2018 | Li | G09G 3/3233 |
| 10,311,790 | B2 * | 6/2019 | Chaji | G09G 3/3233 |
| 10,467,963 | B2 * | 11/2019 | Chaji | G09G 3/3266 |
| 10,546,531 | B2 * | 1/2020 | Li | G09G 3/3275 |
| 10,607,542 | B2 * | 3/2020 | Zhu | G09G 3/3258 |
| 10,810,940 | B2 * | 10/2020 | Chaji | G09G 3/3266 |

* cited by examiner

FIG. 3B
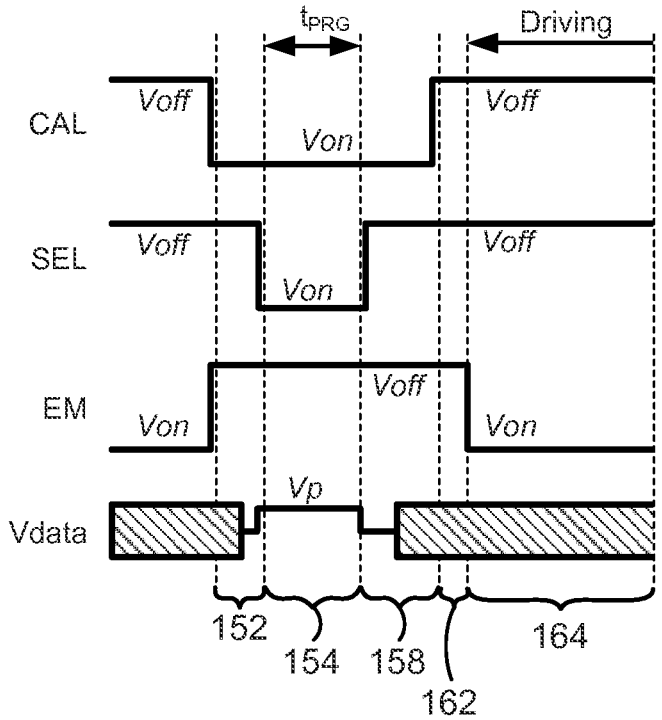
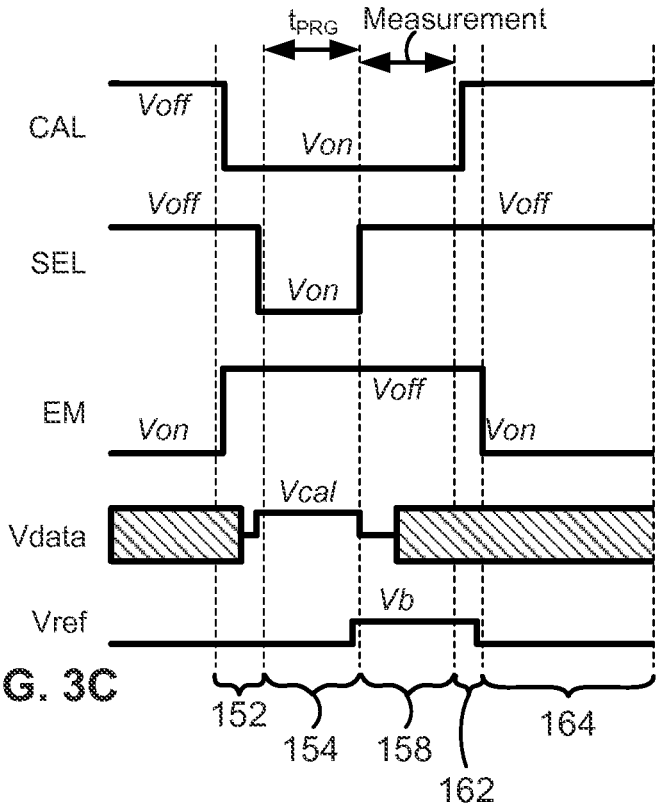
FIG. 3C

FIG. 16
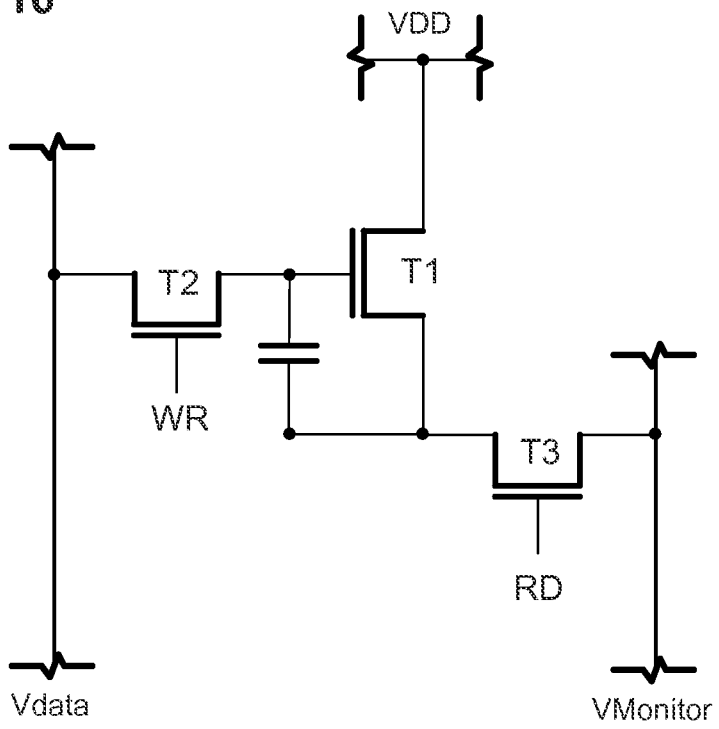
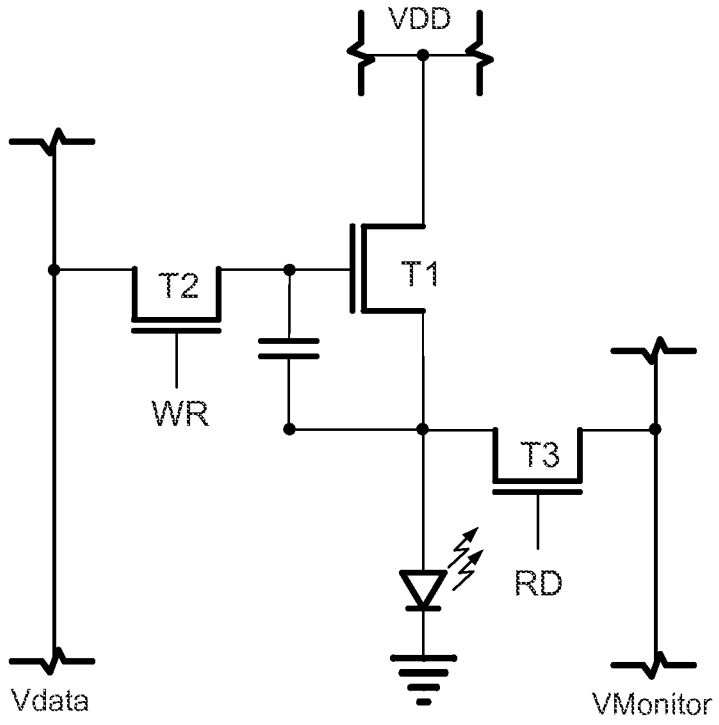
FIG. 17

PIXEL CIRCUITS FOR AMOLED DISPLAYS

CROSS-REFERENCE TO RELATED APPLICATIONS

This application is a continuation of U.S. patent application Ser. No. 16/585,458, filed Sep. 27, 2019, now allowed, which is a continuation of U.S. patent application Ser. No. 16/386,399, filed Apr. 17, 2019, now U.S. Pat. No. 10,467,963, which is a continuation of U.S. patent application Ser. No. 15/979,848, filed May 15, 2018, now U.S. Pat. No. 10,311,790, which is a continuation of U.S. patent application Ser. No. 15/601,146, filed May 22, 2017, now U.S. Pat. No. 9,997,106, which is a continuation of U.S. patent application Ser. No. 15/096,501, filed Apr. 12, 2016, now U.S. Pat. No. 9,685,114, which is a continuation in part of U.S. patent application Ser. No. 14/298,333, filed Jun. 6, 2014, now U.S. Pat. No. 9,336,717 which is a continuation in-part of U.S. patent application Ser. No. 14/363,379, filed Jun. 6, 2014, now U.S. Pat. No. 9,978,310, which is a U.S. National Stage of International Application No. PCT/IB2013/060755, filed Dec. 9, 2013, which claims the benefit of U.S. Provisional Application No. 61/815,698, filed Apr. 24, 2013; U.S. patent application Ser. No. 14/298,333, filed Jun. 6, 2014 is a continuation-in-part of U.S. patent application Ser. No. 13/710,872, filed Dec. 11, 2012, now U.S. Pat. No. 9,786,223 each of which is hereby incorporated by reference herein in its entirety.

FIELD OF THE INVENTION

The present disclosure generally relates to circuits for use in displays, and methods of driving, calibrating, and programming displays, particularly displays such as active matrix organic light emitting diode displays.

BACKGROUND

Displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs tend to demonstrate non-uniform behavior across display panels and over time as the displays age. Compensation techniques can be applied to such displays to achieve image uniformity across the displays and to account for degradation in the displays as the displays age.

Some schemes for providing compensation to displays to account for variations across the display panel and over time utilize monitoring systems to measure time dependent parameters associated with the aging (i.e. degradation) of the pixel circuits. The measured information can then be used to inform subsequent programming of the pixel circuits so as to ensure that any measured degradation is accounted for by adjustments made to the programming. Such monitored pixel circuits may require the use of additional transistors and/or lines to selectively couple the pixel circuits to the monitoring systems and provide for reading out information. The incorporation of additional transistors and/or lines may undesirably decrease pixel-pitch (i.e. "pixel density").

SUMMARY

In accordance with one embodiment, a system for controlling an array of pixels in a display in which each pixel includes a pixel circuit that comprises a light-emitting device; a drive transistor for driving current though the light emitting device according to a driving voltage across the drive transistor during an emission cycle, the drive transistor having a gate, a source and a drain; a storage capacitor coupled to the gate of the drive transistor for controlling the driving voltage; a reference voltage source coupled to a first switching transistor that controls the coupling of the reference voltage source to the storage capacitor; a programming voltage source coupled to a second switching transistor that controls the coupling of the programming voltage to the gate of the drive transistor, so that the storage capacitor stores a voltage equal to the difference between the reference voltage and the programming voltage; and a controller configured to (1) supply a programming voltage that is a calibrated voltage for a known target current, (2) read the actual current passing through the drive transistor to a monitor line, (3) turn off the light emitting device while modifying the calibrated voltage to make the current supplied through the drive transistor substantially the same as the target current, (4) modify the calibrated voltage to make the current supplied through the drive transistor substantially the same as the target current, and (5) determine a current corresponding to the modified calibrated voltage based on predetermined current-voltage characteristics of the drive transistor.

Another embodiment provides a system for controlling an array of pixels in a display in which each pixel includes a pixel circuit that comprises a light-emitting device; a drive transistor for driving current through the light emitting device according to a driving voltage across the drive transistor during an emission cycle, the drive transistor having a gate, a source and a drain; a storage capacitor coupled to the gate of the drive transistor for controlling the driving voltage; a reference voltage source coupled to a first switching transistor that controls the coupling of the reference voltage source to the storage capacitor; a programming voltage source coupled to a second switching transistor that controls the coupling of the programming voltage to the gate of the drive transistor, so that the storage capacitor stores a voltage equal to the difference between the reference voltage and the programming voltage; and a controller configured to (1) supply a programming voltage that is a predetermined fixed voltage, (2) supply a current from an external source to the light emitting device, and (3) read the voltage at the node between the drive transistor and the light emitting device.

In a further embodiment, a system is provided for controlling an array of pixels in a display in which each pixel includes a pixel circuit that comprises a light-emitting device; a drive transistor for driving current through the light emitting device according to a driving voltage across the drive transistor during an emission cycle, the drive transistor having a gate, a source and a drain; a storage capacitor coupled to the gate of the drive transistor for controlling the driving voltage; a reference voltage source coupled to a first switching transistor that controls the coupling of the reference voltage source to the storage capacitor; a programming voltage source coupled to a second switching transistor that controls the coupling of the programming voltage to the gate of the drive transistor, so that the storage capacitor stores a voltage equal to the difference between the reference voltage and the programming voltage; and a controller configured to (1) supply a programming voltage that is an off voltage so that the drive transistor does not provide any current to the light emitting device, (2) supply a current from an external source to a node between the drive transistor and the light emitting device, the external source having a pre-calibrated voltage based on a known target current, (3) modify the pre-calibrated voltage to make the current substantially the same as the target current, (4) read the current corresponding to the modified calibrated voltage, and (5) determine a current corresponding to the modified calibrated voltage based on predetermined current-voltage characteristics of the OLED.

Yet another embodiment provides a system for controlling an array of pixels in a display in which each pixel includes a pixel circuit that comprises a light-emitting device; a drive transistor for driving current through the light emitting device according to a driving voltage across the drive transistor during an emission cycle, the drive transistor having a gate, a source and a drain; a storage capacitor coupled to the gate of the drive transistor for controlling the driving voltage; a reference voltage source coupled to a first switching transistor that controls the coupling of the reference voltage source to the storage capacitor; a programming voltage source coupled to a second switching transistor that controls the coupling of the programming voltage to the gate of the drive transistor, so that the storage capacitor stores a voltage equal to the difference between the reference voltage and the programming voltage; and a controller configured to (1) supply a current from an external source to the light emitting device, and (2) read the voltage at the node between the drive transistor and the light emitting device as the gate voltage of the drive transistor for the corresponding current.

A still further embodiment provides a system for controlling an array of pixels in a display in which each pixel includes a pixel circuit that comprises a light-emitting device; a drive transistor for driving current through the light emitting device according to a driving voltage across the drive transistor during an emission cycle, the drive transistor having a gate, a source and a drain; a storage capacitor coupled to the gate of the drive transistor for controlling the driving voltage; a supply voltage source coupled to a first switching transistor that controls the coupling of the supply voltage source to the storage capacitor and the drive transistor; a programming voltage source coupled to a second switching transistor that controls the coupling of the programming voltage to the gate of the drive transistor, so that the storage capacitor stores a voltage equal to the difference between the reference voltage and the programming voltage; a monitor line coupled to a third switching transistor that controls the coupling of the monitor line to a node between the light emitting device and the drive transistor; and a controller that (1) controls the programming voltage source to produce a voltage that is a calibrated voltage corresponding to a known target current through the drive transistor, (2) controls the monitor line to read a current through the monitor line, with a monitoring voltage low enough to prevent the light emitting device from turning on, (3) controls the programming voltage source to modify the calibrated voltage until the current through the drive transistor is substantially the same as the target current, and (4) identifies a current corresponding to the modified calibrated voltage in predetermined current-voltage characteristics of the drive transistor, the identified current corresponding to the current threshold voltage of the drive transistor.

Another embodiment provides a system for controlling an array of pixels in a display in which each pixel includes a pixel circuit that comprises a light-emitting device; a drive transistor for driving current through the light emitting device according to a driving voltage across the drive transistor during an emission cycle, the drive transistor having a gate, a source and a drain; a storage capacitor coupled to the gate of the drive transistor for controlling the driving voltage; a supply voltage source coupled to a first switching transistor that controls the coupling of the supply voltage source to the storage capacitor and the drive transistor; a programming voltage source coupled to a second switching transistor that controls the coupling of the programming voltage to the gate of the drive transistor, so that the storage capacitor stores a voltage equal to the difference between the reference voltage and the programming voltage; a monitor line coupled to a third switching transistor that controls the coupling of the monitor line to a node between the light emitting device and the drive transistor; and a controller that (1) controls the programming voltage source to produce an off voltage that prevents the drive transistor from passing current to the light emitting device, (2) controls the monitor line to supply a pre-calibrated voltage from the monitor line to a node between the drive transistor and the light emitting device, the pre-calibrated voltage causing current to flow through the node to the light emitting device, the pre-calibrated voltage corresponding to a predetermined target current through the drive transistor, (3) modifies the pre-calibrated voltage until the current flowing through the node to the light emitting device is substantially the same as the target current, and (4) identifies a current corresponding to the modified pre-calibrated voltage in predetermined current-voltage characteristics of the drive transistor, the identified current corresponding to the voltage of the light emitting device.

In accordance with another embodiment, a system is provided for controlling an array of pixels in a display in which each pixel includes a light-emitting device, and each pixel circuit includes the light-emitting device, a drive transistor for driving current through the light-emitting device according to a driving voltage across the drive transistor during an emission cycle, a storage capacitor coupled to the gate of said drive transistor for controlling the driving voltage, a reference voltage source coupled to a first switching transistor that controls the coupling of the reference voltage source to the storage capacitor, a programming voltage source coupled to a second switching transistor that controls the coupling of the programming voltage to the gate of the drive transistor, so that the storage capacitor stores a voltage equal to the difference between the reference voltage and the programming voltage, and a monitor line coupled to a first node between the drive transistor and the light-emitting device through a read transistor. A controller allows the first node to charge to a voltage that is a function of the characteristics of the drive transistor, charges a second node between the storage capacitor and the gate of the drive transistor to the programming voltage, and reads the actual current passing through the drive transistor to the monitor line.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

FIG. 3B is a timing diagram of first exemplary operation cycles for the pixel shown in FIG. 3A.

FIG. 3C is a timing diagram of second exemplary operation cycles for the pixel shown in FIG. 3A.

FIG. 16 is a circuit diagram of a pixel circuit for use in backplane testing.

FIG. 17 is a circuit diagram of a pixel circuit for a full display test.

Figure 1:
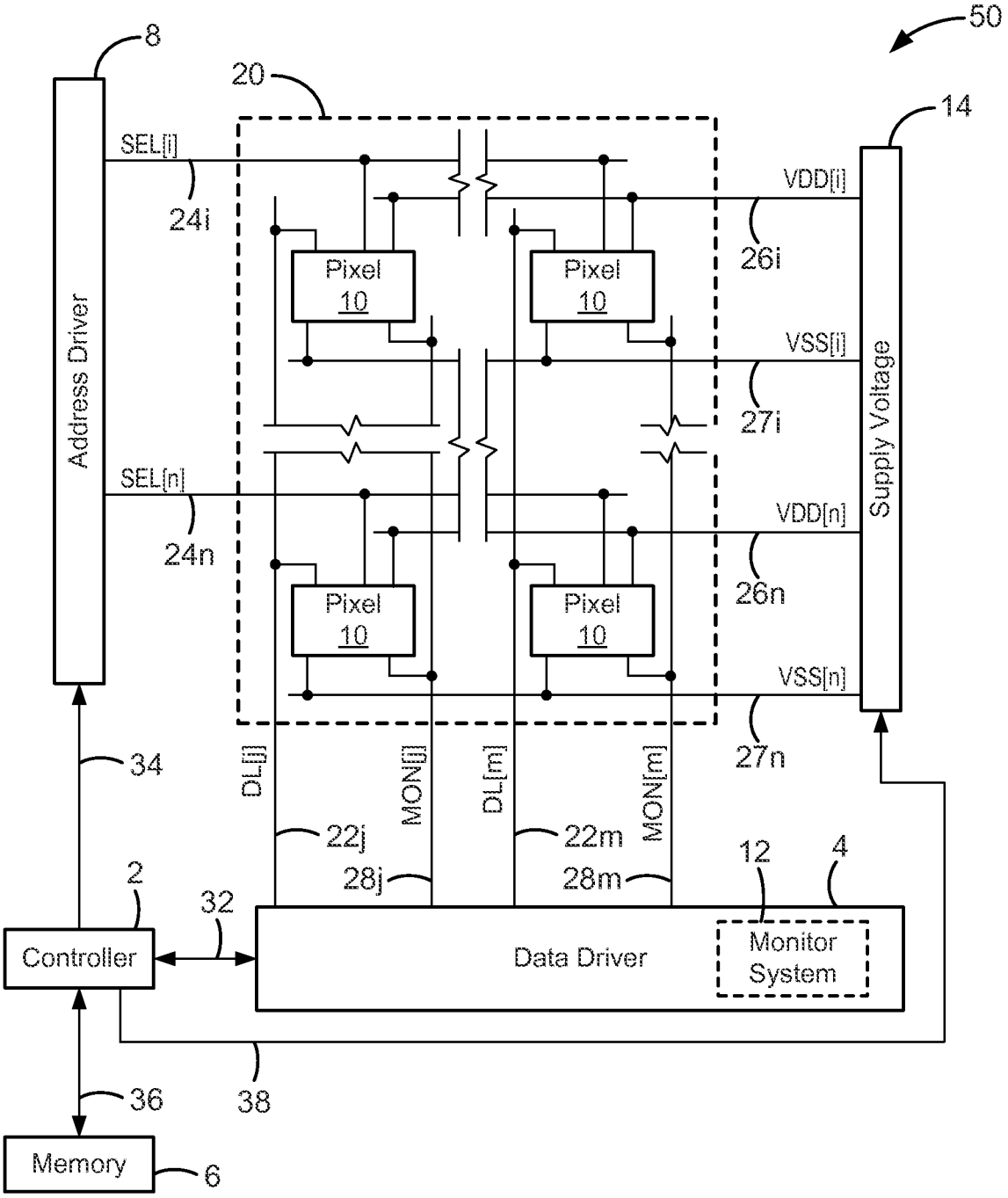
FIG. 1 illustrates an exemplary configuration of a system for driving an OLED display while monitoring the degradation of the individual pixels and providing compensation therefor.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is a diagram of an exemplary display system 50. The display system 50 includes an address driver 8, a data driver 4, a controller 2, a memory storage 6, and display panel 20. The display panel 20 includes an array of pixels 10 arranged in rows and columns. Each of the pixels 10 are individually programmable to emit light with individually programmable luminance values. The controller 2 receives digital data indicative of information to be displayed on the display panel 20. The controller 2 sends signals 32 to the data driver 4 and scheduling signals 34 to the address driver 8 to drive the pixels 10 in the display panel 20 to display the information indicated. The plurality of pixels 10 associated with the display panel 20 thus comprise a display array ("display screen") adapted to dynamically display information according to the input digital data received by the controller 2. The display screen can display, for example, video information from a stream of video data received by the controller 2. The supply voltage 14 can provide a constant power voltage or can be an adjustable voltage supply that is controlled by signals from the controller 2. The display system 50 can also incorporate features from a current source or sink (not shown) to provide biasing currents to the pixels 10 in the display panel 20 to thereby decrease programming time for the pixels 10.

For illustrative purposes, the display system 50 in FIG. 1 is illustrated with only four pixels 10 in the display panel 20. It is understood that the display system 50 can be implemented with a display screen that includes an array of similar pixels, such as the pixels 10, and that the display screen is not limited to a particular number of rows and columns of pixels. For example, the display system 50 can be implemented with a display screen with a number of rows and columns of pixels commonly available in displays for mobile devices, monitor-based devices, and/or projection-devices.

The pixel 10 is operated by a driving circuit ("pixel circuit") that generally includes a drive transistor and a light emitting device. Hereinafter the pixel 10 may refer to the pixel circuit. The light emitting device can optionally be an organic light emitting diode, but implementations of the present disclosure apply to pixel circuits having other electroluminescence devices, including current-driven light emitting devices. The drive transistor in the pixel 10 can optionally be an n-type or p-type amorphous silicon thin-film transistor, but implementations of the present disclosure are not limited to pixel circuits having a particular polarity of transistor or only to pixel circuits having thin-film transistors. The pixel circuit 10 can also include a storage capacitor for storing programming information and allowing the pixel circuit 10 to drive the light emitting device after being addressed. Thus, the display panel 20 can be an active matrix display array.

As illustrated in FIG. 1, the pixel 10 illustrated as the top-left pixel in the display panel 20 is coupled to a select line 24*j*, a supply line 26*j*, a data line 22*i*, and a monitor line 28*i*. In an implementation, the supply voltage 14 can also provide a second supply line to the pixel 10. For example, each pixel can be coupled to a first supply line charged with Vdd and a second supply line coupled with Vss, and the pixel circuits 10 can be situated between the first and second supply lines to facilitate driving current between the two supply lines during an emission phase of the pixel circuit. The top-left pixel 10 in the display panel 20 can correspond a pixel in the display panel in a "jth" row and "ith" column of the display panel 20. Similarly, the top-right pixel 10 in the display panel 20 represents a "jth" row and "mth" column; the bottom-left pixel 10 represents an "nth" row and "ith" column; and the bottom-right pixel 10 represents an "nth" row and "ith" column. Each of the pixels 10 is coupled to appropriate select lines (e.g., the select lines 24*j* and 24*n*), supply lines (e.g., the supply lines 26*j* and 26*n*), data lines (e.g., the data lines 22*i* and 22*m*), and monitor lines (e.g., the monitor lines 28*i* and 28*m*). It is noted that aspects of the present disclosure apply to pixels having additional connections, such as connections to additional select lines, and to pixels having fewer connections, such as pixels lacking a connection to a monitoring line.

With reference to the top-left pixel 10 shown in the display panel 20, the select line 24*j* is provided by the address driver 8, and can be utilized to enable, for example, a programming operation of the pixel 10 by activating a switch or transistor to allow the data line 22*i* to program the pixel 10. The data line 22*i* conveys programming information from the data driver 4 to the pixel 10. For example, the data line 22*i* can be utilized to apply a programming voltage or a programming current to the pixel 10 in order to program the pixel 10 to emit a desired amount of luminance. The programming voltage (or programming current) supplied by the data driver 4 via the data line 22*i* is a voltage (or current) appropriate to cause the pixel 10 to emit light with a desired amount of luminance according to the digital data received by the controller 2. The programming voltage (or programming current) can be applied to the pixel 10 during a programming operation of the pixel 10 so as to charge a storage device within the pixel 10, such as a storage capacitor, thereby enabling the pixel 10 to emit light with the desired amount of luminance during an emission operation following the programming operation. For example, the storage device in the pixel 10 can be charged during a programming operation to apply a voltage to one or more of a gate or a source terminal of the drive transistor during the emission operation, thereby causing the drive transistor to convey the driving current through the light emitting device according to the voltage stored on the storage device.

Generally, in the pixel 10, the driving current that is conveyed through the light emitting device by the drive transistor during the emission operation of the pixel 10 is a current that is supplied by the first supply line 26*j* and is drained to a second supply line (not shown). The first supply line 22*j* and the second supply line are coupled to the voltage supply 14. The first supply line 26*j* can provide a positive supply voltage (e.g., the voltage commonly referred to in circuit design as "Vdd") and the second supply line can provide a negative supply voltage (e.g., the voltage commonly referred to in circuit design as "Vss"). Implementations of the present disclosure can be realized where one or the other of the supply lines (e.g., the supply line 26*j*) are fixed at a ground voltage or at another reference voltage.

The display system 50 also includes a monitoring system 12. With reference again to the top left pixel 10 in the display panel 20, the monitor line 28*i* connects the pixel 10 to the monitoring system 12. The monitoring system 12 can be integrated with the data driver 4, or can be a separate stand-alone system. In particular, the monitoring system 12 can optionally be implemented by monitoring the current and/or voltage of the data line 22*i* during a monitoring operation of the pixel 10, and the monitor line 28*i* can be entirely omitted. Additionally, the display system 50 can be implemented without the monitoring system 12 or the monitor line 28*i*. The monitor line 28*i* allows the monitoring system 12 to measure a current or voltage associated with the pixel 10 and thereby extract information indicative of a degradation of the pixel 10. For example, the monitoring system 12 can extract, via the monitor line 28*i*, a current flowing through the drive transistor within the pixel 10 and thereby determine, based on the measured current and based on the voltages applied to the drive transistor during the measurement, a threshold voltage of the drive transistor or a shift thereof.

The monitoring system 12 can also extract an operating voltage of the light emitting device (e.g., a voltage drop across the light emitting device while the light emitting device is operating to emit light). The monitoring system 12 can then communicate the signals 32 to the controller 2 and/or the memory 6 to allow the display system 50 to store the extracted degradation information in the memory 6. During subsequent programming and/or emission operations of the pixel 10, the degradation information is retrieved from the memory 6 by the controller 2 via the memory signals 36, and the controller 2 then compensates for the extracted degradation information in subsequent programming and/or emission operations of the pixel 10. For example, once the degradation information is extracted, the programming information conveyed to the pixel 10 via the data line 22*i* can be appropriately adjusted during a subsequent programming operation of the pixel 10 such that the pixel 10 emits light with a desired amount of luminance that is independent of the degradation of the pixel 10. In an example, an increase in the threshold voltage of the drive transistor within the pixel 10 can be compensated for by appropriately increasing the programming voltage applied to the pixel 10.

Figure 2A:
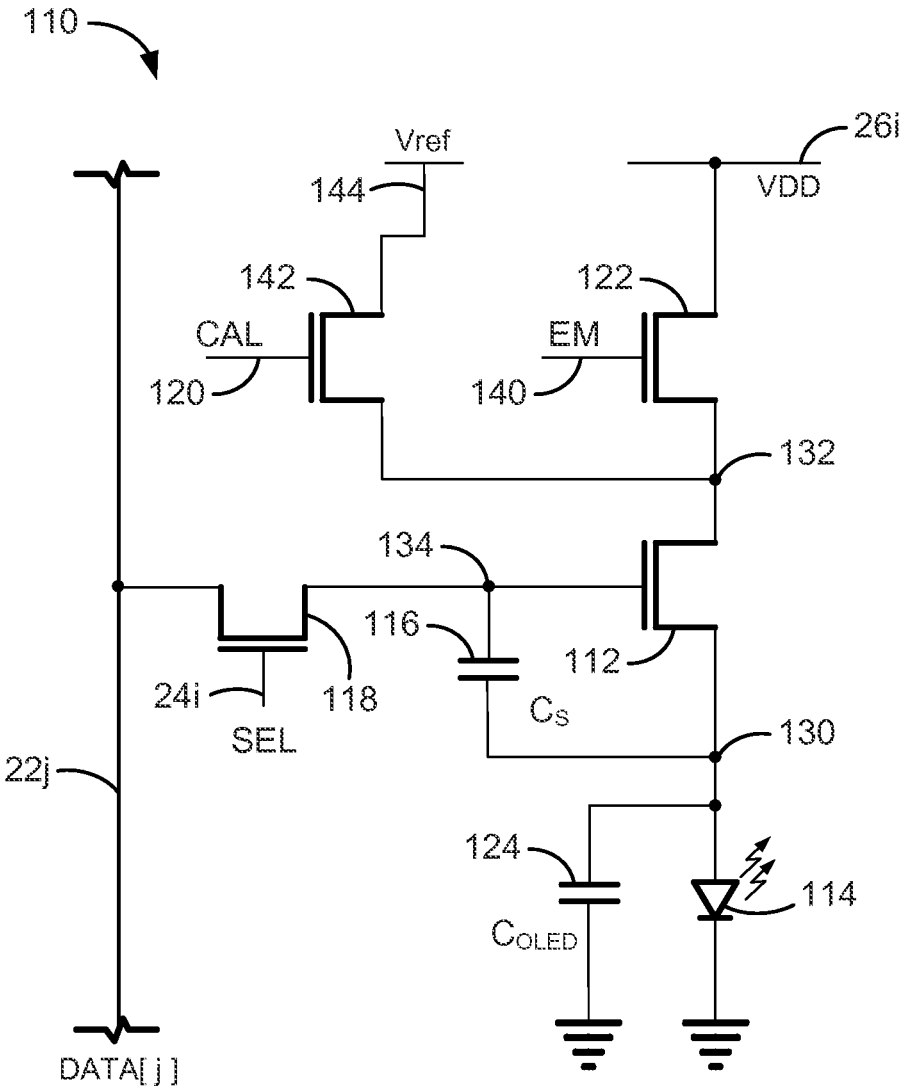
FIG. 2A is a circuit diagram of an exemplary pixel circuit configuration.

FIG. 2A is a circuit diagram of an exemplary driving circuit for a pixel 110. The driving circuit shown in FIG. 2A is utilized to calibrate, program, and drive the pixel 110 and includes a drive transistor 112 for conveying a driving current through an organic light emitting diode ("OLED") 114. The OLED 114 emits light according to the current passing through the OLED 114, and can be replaced by any current-driven light emitting device. The OLED 114 has an inherent capacitance 12. The pixel 110 can be utilized in the display panel 20 of the display system 50 described in connection with FIG. 1.

The driving circuit for the pixel 110 also includes a storage capacitor 116 and a switching transistor 118. The pixel 110 is coupled to a reference voltage line 144, a select line 24*i*, a voltage supply line 26*i*, and a data line 22*j*. The drive transistor 112 draws a current from the voltage supply line 26*i* according to a gate-source voltage (Vgs) across the gate and source terminals of the drive transistor 112. For example, in a saturation mode of the drive transistor 112, the current passing through the drive transistor can be given by $Ids=\beta(Vgs-Vt)^2$, where, β is a parameter that depends on device characteristics of the drive transistor 112, Ids is the current from the drain terminal of the drive transistor 112 to the source terminal of the drive transistor 112, and Vt is the threshold voltage of the drive transistor 112.

In the pixel 110, the storage capacitor 116 is coupled across the gate and source terminals of the drive transistor 112. The storage capacitor 116 has a first terminal 116*g*, which is referred to for convenience as a gate-side terminal 116*g*, and a second terminal 116*s*, which is referred to for convenience as a source-side terminal 116*s*. The gate-side terminal 116*g* of the storage capacitor 116 is electrically coupled to the gate terminal of the drive transistor 112. The source-side terminal 116*s* of the storage capacitor 116 is electrically coupled to the source terminal of the drive transistor 112. Thus, the gate-source voltage Vgs of the drive transistor 112 is also the voltage charged on the storage capacitor 116. As will be explained further below, the storage capacitor 116 can thereby maintain a driving voltage across the drive transistor 112 during an emission phase of the pixel 110.

The drain terminal of the drive transistor 112 is electrically coupled to the voltage supply line 26*i* through an emission transistor 160, and to the reference voltage line 144 through a calibration transistor 142. The source terminal of the drive transistor 112 is electrically coupled to an anode terminal of the OLED 114. A cathode terminal of the OLED 114 can be connected to ground or can optionally be connected to a second voltage supply line, such as a supply line Vss (not shown). Thus, the OLED 114 is connected in series with the current path of the drive transistor 112. The OLED 114 emits light according to the magnitude of the current passing through the OLED 114, once a voltage drop across the anode and cathode terminals of the OLED achieves an operating voltage ($V_{OLED}$) of the OLED 114. That is, when the difference between the voltage on the anode terminal and the voltage on the cathode terminal is greater than the operating voltage $V_{OLED}$, the OLED 114 turns on and emits light. When the anode to cathode voltage is less than $V_{OLED}$, current does not pass through the OLED 114.

The switching transistor 118 is operated according to a select line 24*i* (e.g., when the voltage SEL on the select line 24*i* is at a high level, the switching transistor 118 is turned on, and when the voltage SEL is at a low level, the switching transistor is turned off). When turned on, the switching transistor 118 electrically couples the gate terminal of the drive transistor (and the gate-side terminal 116*g* of the storage capacitor 116) to the data line 22*j*.

The drain terminal of the drive transistor 112 is coupled to the VDD line 26*i* via an emission transistor 122, and to a Vref line 144 via a calibration transistor 142. The emission transistor 122 is controlled by the voltage on an EM line 140 connected to the gate of the transistor 122, and the calibration transistor 142 is controlled by the voltage on a CAL line 140 connected to the gate of the transistor 142. As will be described further below in connection with FIG. 2B, the reference voltage line 144 can be maintained at a ground voltage or another fixed reference voltage (Vref) and can optionally be adjusted during a programming phase of the pixel 110 to provide compensation for degradation of the pixel 110.

Figure 2B:
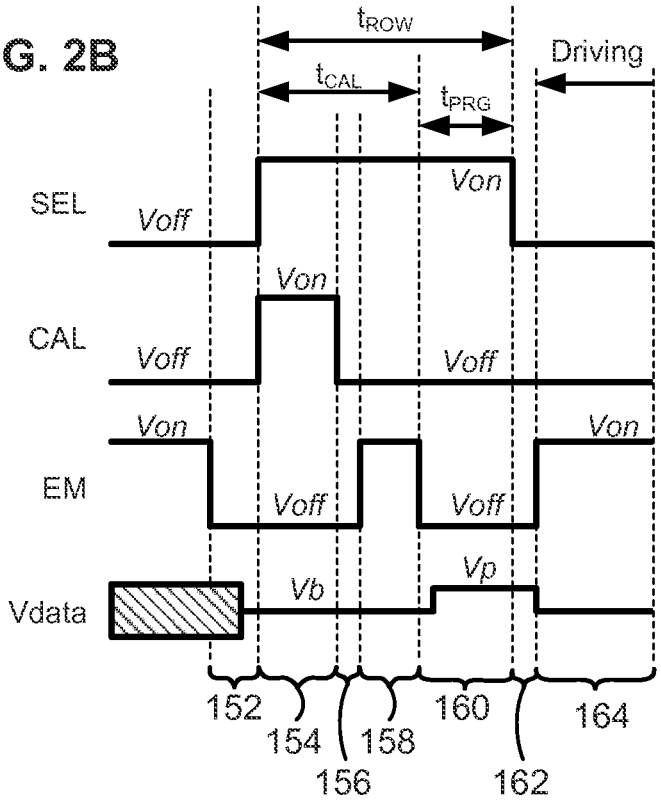
FIG. 2B is a timing diagram of first exemplary operation cycles for the pixel shown in FIG. 2A.

FIG. 2B is a schematic timing diagram of exemplary operation cycles for the pixel 110 shown in FIG. 2A. The pixel 110 can be operated in a calibration cycle $t_{CAL}$ having two phases 154 and 158 separated by an interval 156, a program cycle 160, and a driving cycle 164. During the first phase 154 of the calibration cycle, both the SEL line and the CAL lines are high, so the corresponding transistors 118 and 142 are turned on. The calibration transistor 142 applies the voltage Vref, which has a level that turns the OLED 114 off, to the node 132 between the source of the emission transistor 122 and the drain of the drive transistor 112. The switching transistor 118 applies the voltage Vdata, which is at a biasing voltage level Vb, to the gate of the drive transistor 112 to allow the voltage Vref to be transferred from the node 132 to the node 130 between the source of the drive transistor 112 and the anode of the OLED 114. The voltage on the CAL line goes low at the end of the first phase 154, while the voltage on the SEL line remains high to keep the drive transistor 112 turned on.

During the second phase 158 of the calibration cycle $t_{CAL}$, the voltage on the EM line 140 goes high to turn on the emission transistor 122, which causes the voltage at the node 130 to increase. If the phase 158 is long enough, the voltage at the node 130 reaches a value (Vb−Vt), where Vt is the threshold voltage of the drive transistor 112. If the phase 158 is not long enough to allow that value to be reached, the voltage at the node 130 is a function of Vt and the mobility of the drive transistor 112. This is the voltage stored in the capacitor 116.

The voltage at the node 130 is applied to the anode terminal of the OLED 114, but the value of that voltage is chosen such that the voltage applied across the anode and cathode terminals of the OLED 114 is less than the operating voltage $V_{OLED}$ of the OLED 114, so that the OLED 114 does not draw current. Thus, the current flowing through the drive transistor 112 during the calibration phase 158 does not pass through the OLED 114.

During the programming cycle 160, the voltages on both lines EM and CAL are low, so both the emission transistor 122 and the calibration transistor 142 are off. The SEL line remains high to turn on the switching transistor 116, and the data line 22*j* is set to a programming voltage Vp, thereby charging the node 134, and thus the gate of the drive transistor 112, to Vp. The node 130 between the OLED and the source of the drive transistor 112 holds the voltage created during the calibration cycle, since the OLED capacitance is large. The voltage charged on the storage capacitor 116 is the difference between Vp and the voltage created during the calibration cycle. Because the emission transistor 122 is off during the programming cycle, the charge on the capacitor 116 cannot be affected by changes in the voltage level on the Vdd line 26*i*.

During the driving cycle 164, the voltage on the EM line goes high, thereby turning on the emission transistor 122, while both the switching transistor 118 and the and the calibration transistor 142 remain off. Turning on the emission transistor 122 causes the drive transistor 112 to draw a driving current from the VDD supply line 26*i*, according to the driving voltage on the storage capacitor 116. The OLED 114 is turned on, and the voltage at the anode of the OLED adjusts to the operating voltage $V_{OLED}$. Since the voltage stored in the storage capacitor 116 is a function of the threshold voltage Vt and the mobility of the drive transistor 112, the current passing through the OLED 114 remains stable.

The SEL line 24*i* is low during the driving cycle, so the switching transistor 118 remains turned off. The storage capacitor 116 maintains the driving voltage, and the drive transistor 112 draws a driving current from the voltage supply line 26*i* according to the value of the driving voltage on the capacitor 116. The driving current is conveyed through the OLED 114, which emits a desired amount of light according to the amount of current passed through the OLED 114. The storage capacitor 116 maintains the driving voltage by self-adjusting the voltage of the source terminal and/or gate terminal of the drive transistor 112 so as to account for variations on one or the other. For example, if the voltage on the source-side terminal of the capacitor 116 changes during the driving cycle 164 due to, for example, the anode terminal of the OLED 114 settling at the operating voltage $V_{OLED}$, the storage capacitor 116 adjusts the voltage on the gate terminal of the drive transistor 112 to maintain the driving voltage across the gate and source terminals of the drive transistor.

Figure 2C:
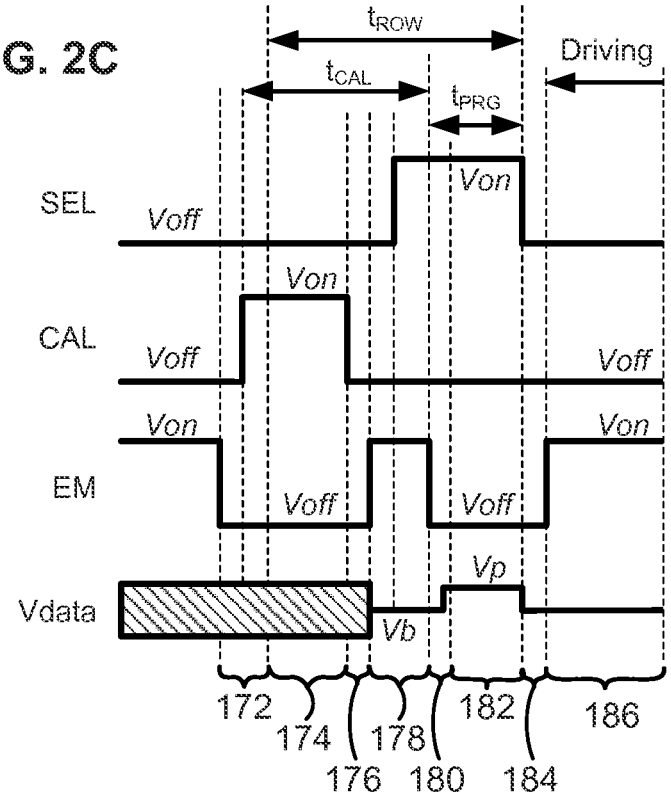
FIG. 2C is a timing diagram of second exemplary operation cycles for the pixel shown in FIG. 2A.

FIG. 2C is a modified timing diagram in which the voltage on the data line 22*j* is used to charge the node 130 to Vref during a longer first phase 174 of the calibration cycle $t_{CAL}$. This makes the CAL signal the same as the SEL signal for the previous row of pixels, so the previous SEL signal (SEL[n−1]) can be used as the CAL signal for the nth row.

While the driving circuit illustrated in FIG. 2A is illustrated with n-type transistors, which can be thin-film transistors and can be formed from amorphous silicon, the driving circuit illustrated in FIG. 2A and the operating cycles illustrated in FIG. 2B can be extended to a complementary circuit having one or more p-type transistors and having transistors other than thin film transistors.

Figure 3A:
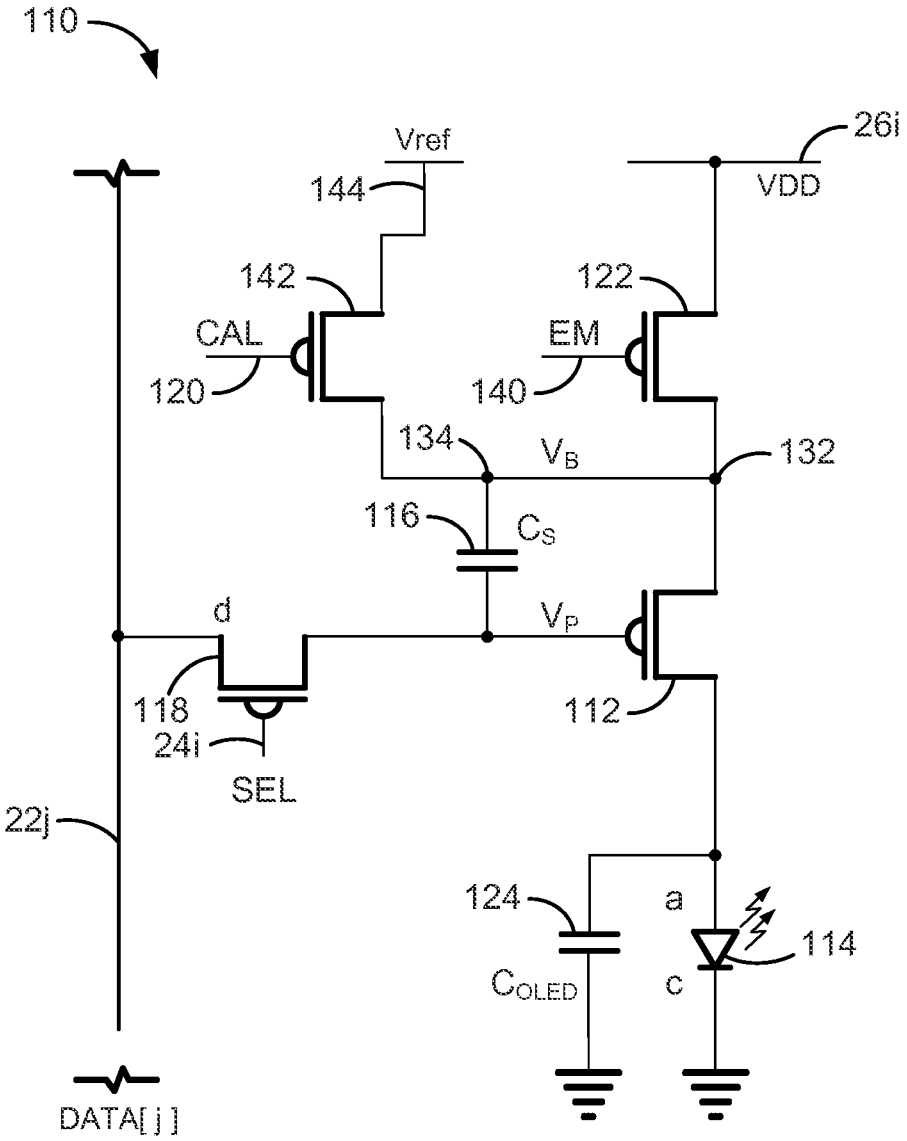
FIG. 3A is a circuit diagram of an exemplary pixel circuit configuration.

FIG. 3A is a modified version of the driving circuit of FIG. 2A using p-type transistors, with the storage capacitor 116 connected between the gate and source terminals of the drive transistor 112. As can be seen in the timing diagram in FIG. 3B, the emission transistor 122 disconnects the pixel 110 in FIG. 3A from the VDD line during the programming cycle 154, to avoid any effect of VDD variations on the pixel current. The calibration transistor 142 is turned on by the CAL line 120 during the programming cycle 154, which applies the voltage Vref to the node 132 on one side of the capacitor 116, while the switching transistor 118 is turned on by the SEL line to apply the programming voltage Vp to the node 134 on the opposite side of the capacitor. Thus, the voltage stored in the storage capacitor 116 during programming in FIG. 3A will be (Vp−Vref). Since there is small current flowing in the Vref line, the voltage is stable. During the driving cycle 164, the VDD line is connected to the pixel, but it has no effect on the voltage stored in the capacitor 116 since the switching transistor 118 is off during the driving cycle.

FIG. 3C is a timing diagram illustrating how TFT transistor and OLED readouts are obtained in the circuit of FIG. 3A. For a TFT readout, the voltage Vcal on the DATA line 22*j* during the programming cycle 154 should be a voltage related to the desired current. For an OLED readout, during the measurement cycle 158 the voltage Vcal is sufficiently low to force the drive transistor 112 to act as a switch, and the voltage Vb on the Vref line 144 and node 132 is related to the OLED voltage. Thus, the TFT and OLED readouts can be obtained from the DATA line 120 and the node 132, respectively, during different cycles.

Figure 4A:
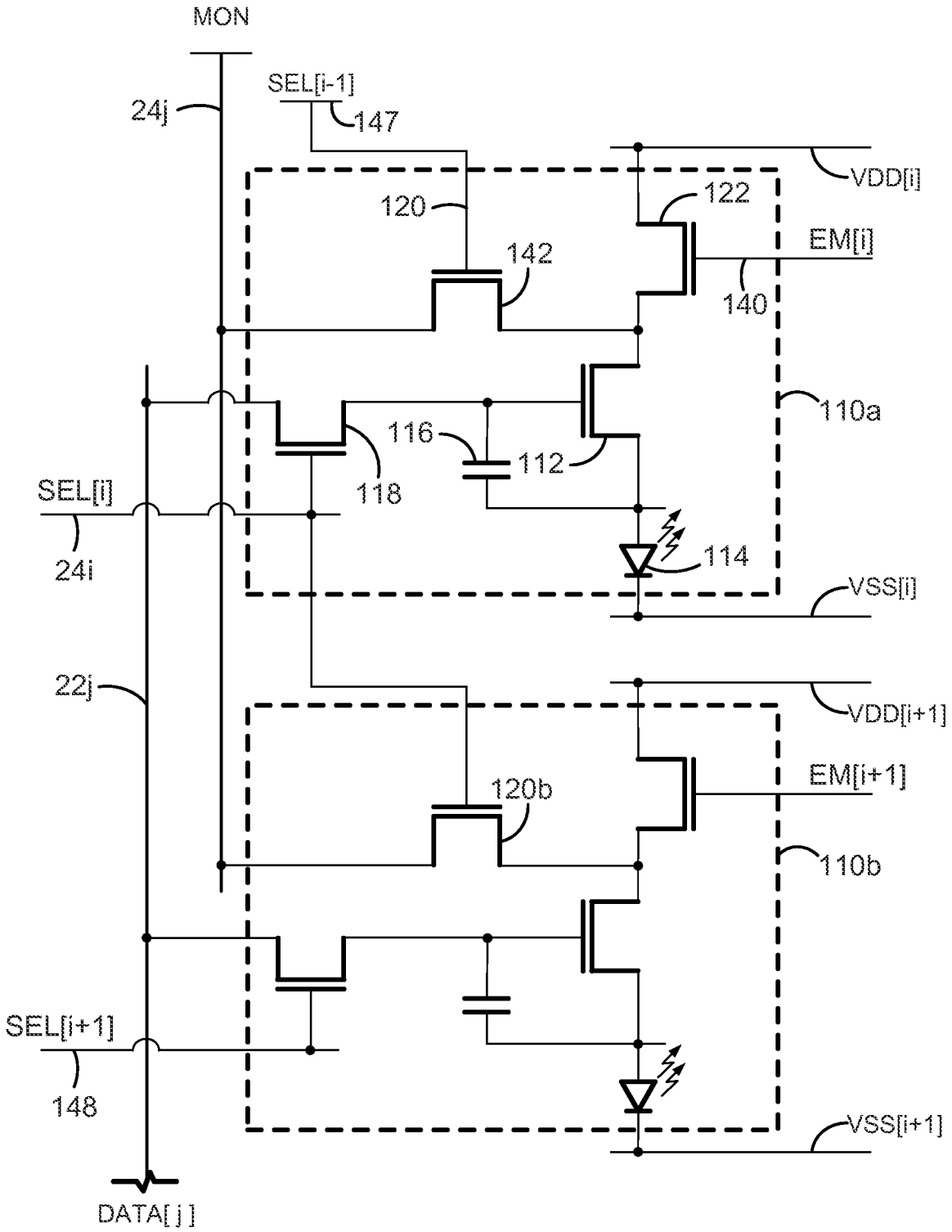
FIG. 4A is a circuit diagram of an exemplary pixel circuit configuration.

FIG. 4A is a circuit diagram showing how two of the FIG. 2A pixels located in the same column j and in adjacent rows I and i+1 of a display can be connected to three SEL lines SEL[i−1], SEL[i] and SEL[i+1], two VDD lines VDD[i] and VDD[i+1], two EM lines EM[i] and EM[i+1], two VSS lines VSS[i] and VSS[i+1], a common Vref2/MON line 24*j* and a common DATA line 22*j*. Each column of pixels has its own DATA and Vref2/MON lines that are shared by all the pixels in that column. Each row of pixels has its own VDD, VSS, EM and SEL lines that are shared by all the pixels in that row. In addition, the calibration transistor 142 of each pixel has its gate connected to the SEL line of the previous row (SEL[i−1]). This is an efficient arrangement when external compensation is provided for the OLED efficiency as the display ages, while in-pixel compensation is used for other parameters such as $V_{OLED}$, temperature-induced degradation, IR drop (e.g., in the VDD lines), hysteresis, etc.

Figure 4B:
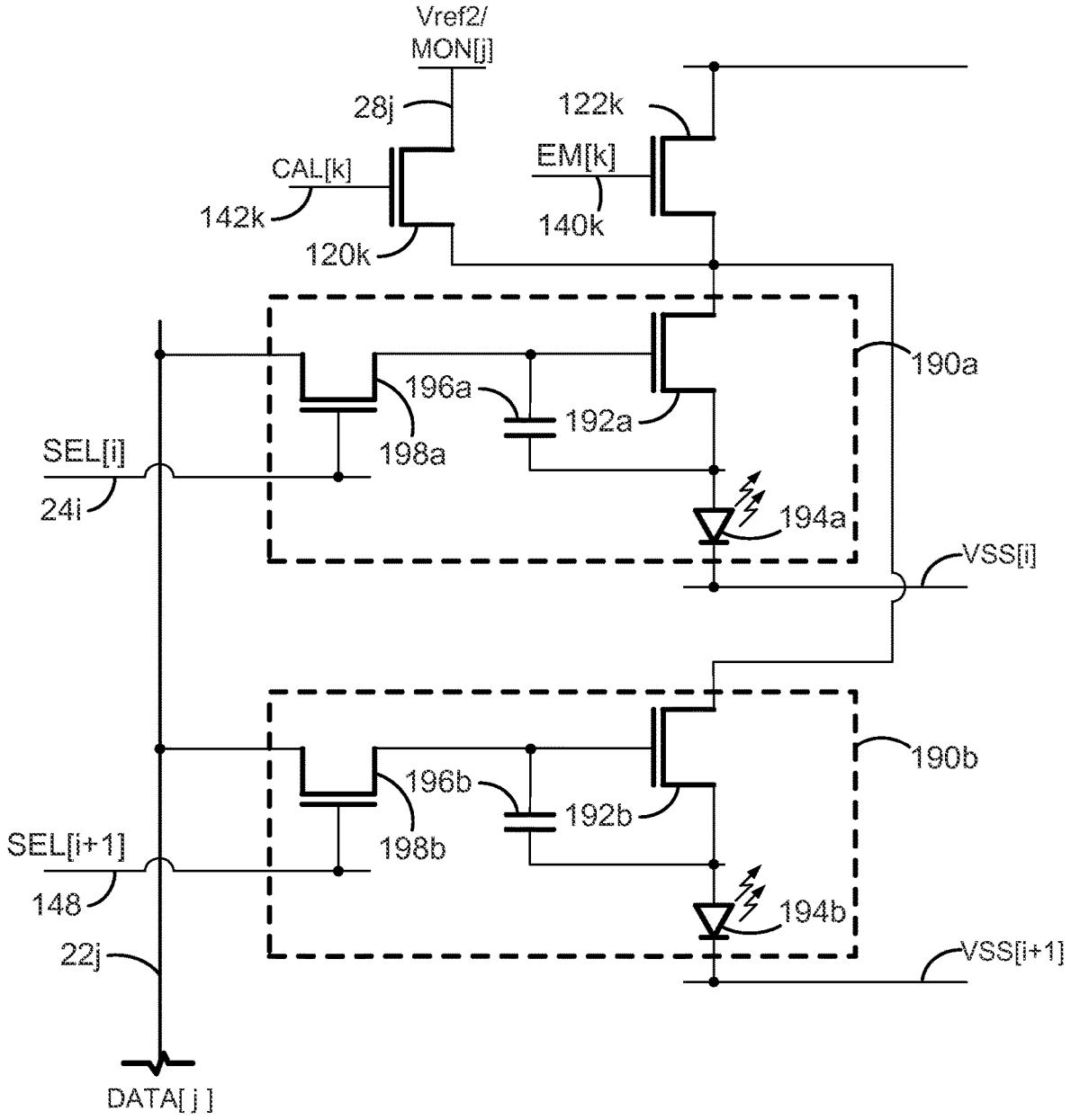
FIG. 4B is a circuit diagram of a modified configuration for two identical pixel circuits in a display.

FIG. 4B is a circuit diagram showing how the two pixels shown in FIG. 4A can be simplified by sharing common calibration and emission transistors 120 and 140 and common Vref2/MON and VDD lines. It can be seen that the number of transistors required is significantly reduced.

Figure 5A:
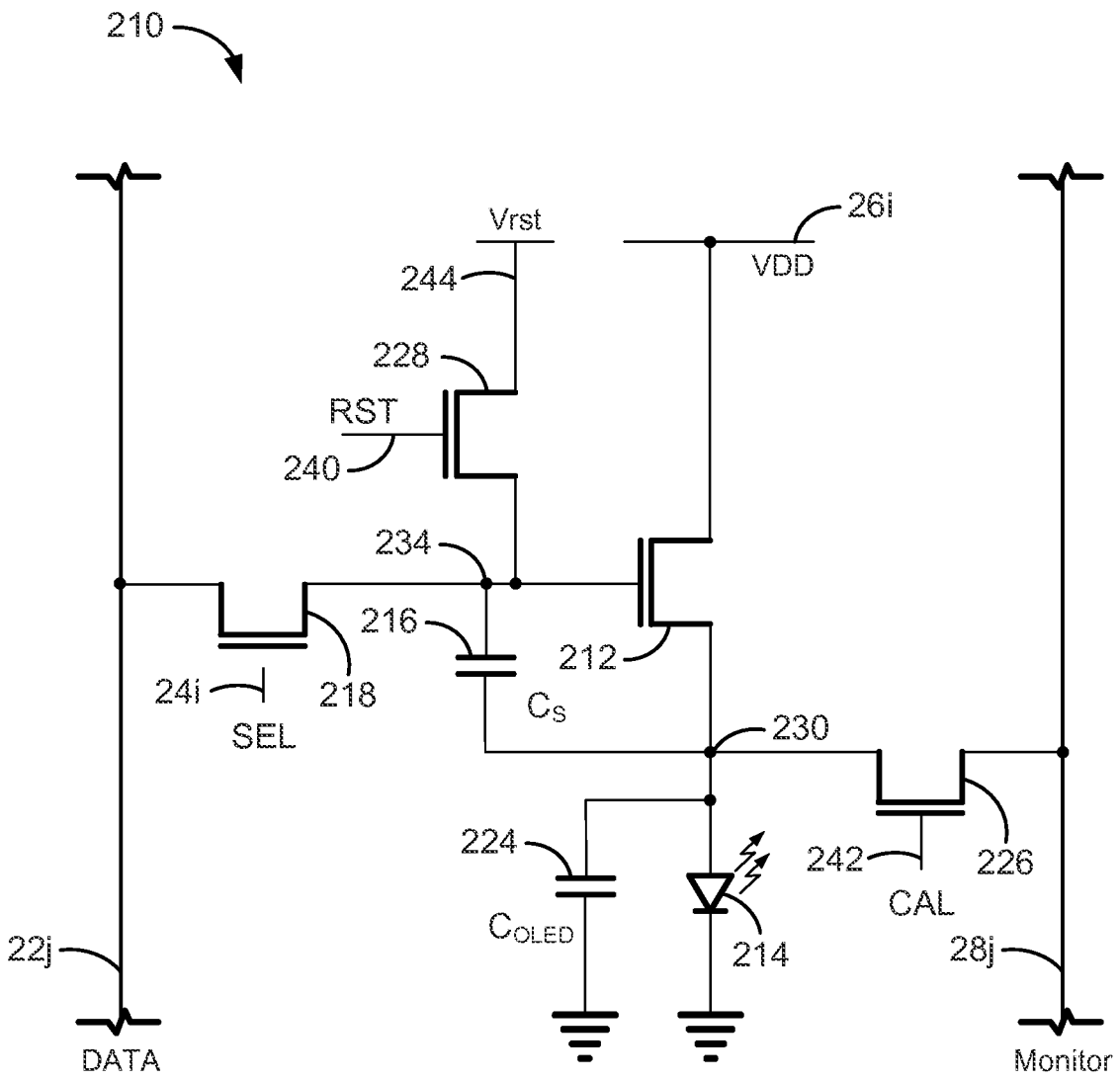
FIG. 5A is a circuit diagram of an exemplary pixel circuit configuration.

FIG. 5A is a circuit diagram of an exemplary driving circuit for a pixel 210 that includes a monitor line 28*j* coupled to the node 230 by a calibration transistor 226 controlled by a CAL line 242, for reading the current values of operating parameters such as the drive current and the OLED voltage. The circuit of FIG. 5A also includes a reset transistor 228 for controlling the application of a reset voltage Vrst to the gate of the drive transistor 212. The drive transistor 212, the switching transistor 218 and the OLED 214 are the same as described above in the circuit of FIG. 2A.

Figure 5B:
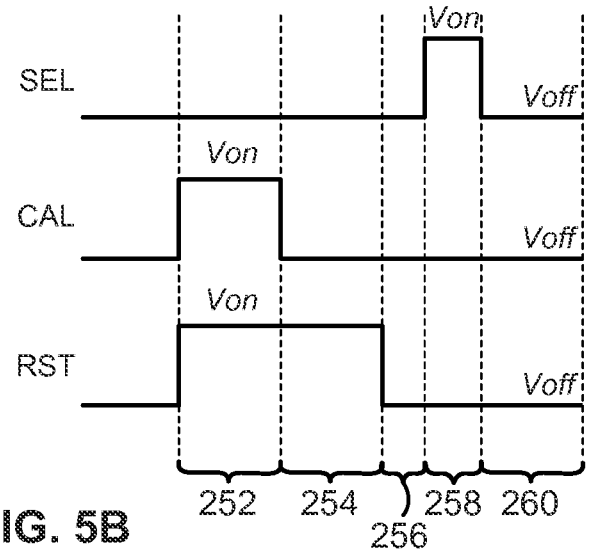
FIG. 5B is a timing diagram of first exemplary operation cycles for the pixel illustrated in FIG. 5A.

FIG. 5B is a schematic timing diagram of exemplary operation cycles for the pixel 210 shown in FIG. 5A. At the beginning of the cycle 252, the RST and CAL lines go high at the same time, thereby turning on both the transistors 228 and 226 for the cycle 252, so that a voltage is applied to the monitor line 28*j*. The drive transistor 212 is on, and the OLED 214 is off. During the next cycle 254, the RST line stays high while the CAL line goes low to turn off the transistor 226, so that the drive transistor 212 charges the node 230 until the drive transistor 212 is turned off, e.g., by the RST line going low at the end of the cycle 254. At this point the gate-source voltage Vgs of the drive transistor 212 is the Vt of that transistor. If desired, the timing can be selected so that the drive transistor 212 does not turn off during the cycle 254, but rather charges the node 230 slightly. This charge voltage is a function of the mobility, Vt and other parameters of the transistor 212 and thus can compensate for all these parameters.

During the programming cycle 258, the SEL line 24*i* goes high to turn on the switching transistor 218. This connects the gate of the drive transistor 212 to the DATA line, which charges the the gate of transistor 212 to Vp. The gate-source voltage Vgs of the transistor 212 is then Vp+Vt, and thus the current through that transistor is independent of the threshold voltage Vt:

$$I = (Vgs - Vt)^2$$
$$= (Vp + Vt - Vt)^2$$
$$= Vp^2$$

Figure 5C:
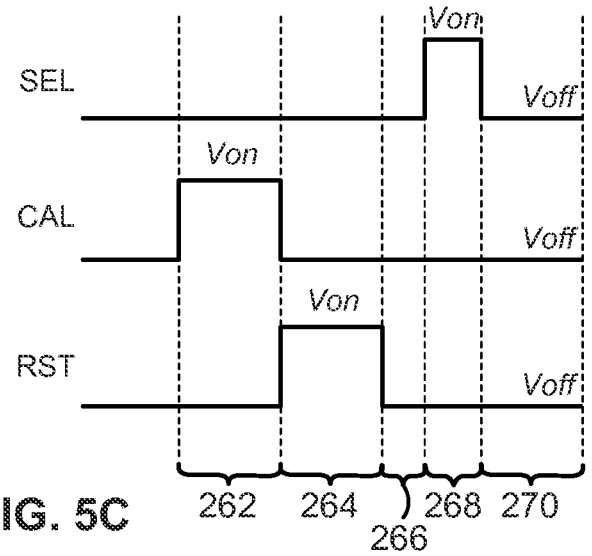
FIG. 5C is a timing diagram of second exemplary operation cycles for the pixel illustrated in FIG. 5A.
Figure 5D:
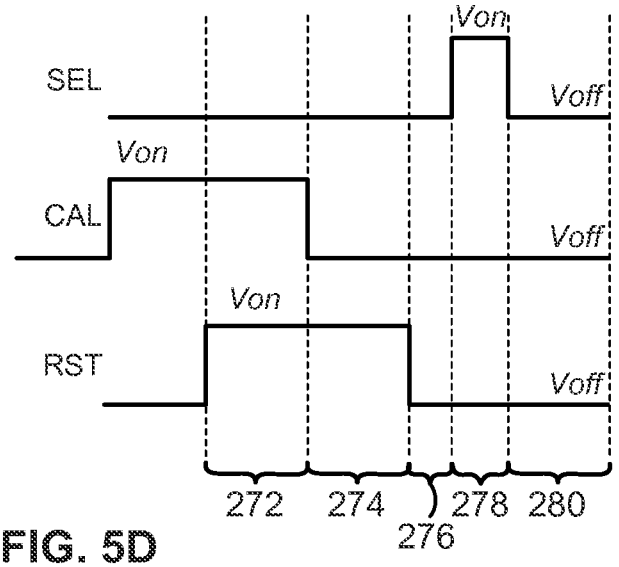
FIG. 5D is a timing diagram of third exemplary operation cycles for the pixel illustrated in FIG. 5A.

The timing diagrams in FIGS. 5C and 5D as described above for the timing diagram of FIG. 5B, but with symmetric signals for CAL and RST so they can be shared, e.g., CAL[n] can be used as RST[n−1].

Figure 5E:
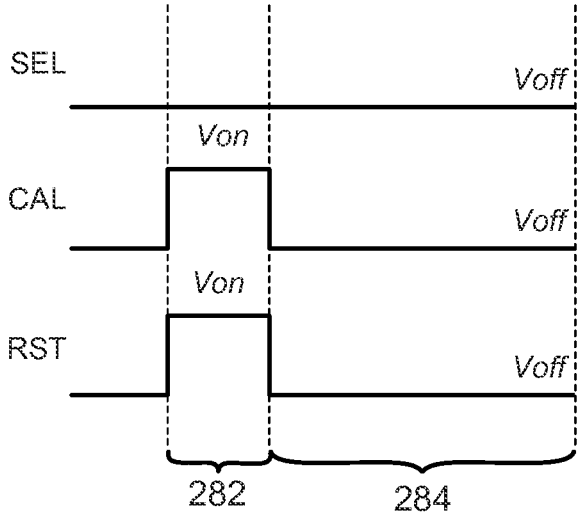
FIG. 5E is a timing diagram of fourth exemplary operation cycles for the pixel illustrated in FIG. 5A.

FIG. 5E illustrates a timing diagram that permits the measuring of the OLED voltage and/or current through the monitor line 28*j* while the RST line is high to turn on the transistor 228, during the cycle 282, while the drive transistor 212 is off.

Figure 5F:
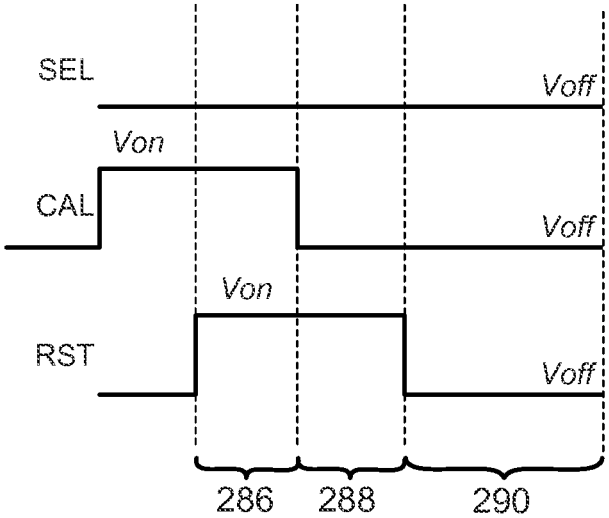
FIG. 5F is a timing diagram of fifth exemplary operation cycles for the pixel illustrated in FIG. 5A.

FIG. 5F illustrates a timing diagram that offers functionality similar to that of FIG. 5E. However, with the timing shown in FIG. 5F, each pixel in a given row n can use the reset signal from the previous row n−1 (RST[n−1]) as the calibration signal CAL[n] in the current row n, thereby reducing the number of signals required.

Figure 6B:
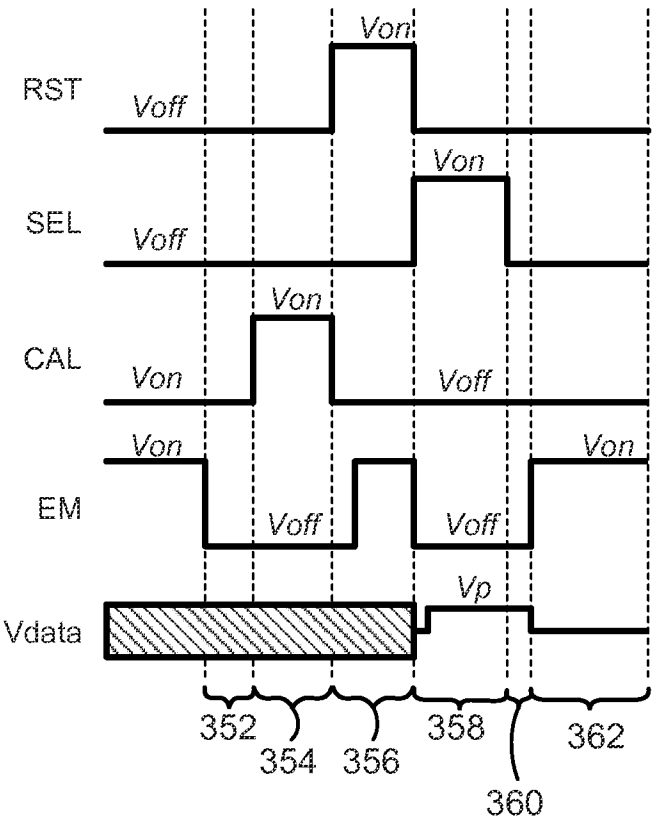
FIG. 6B is a timing diagram of exemplary operation cycles for the pixel illustrated in FIG. 6A.
Figure 6A:
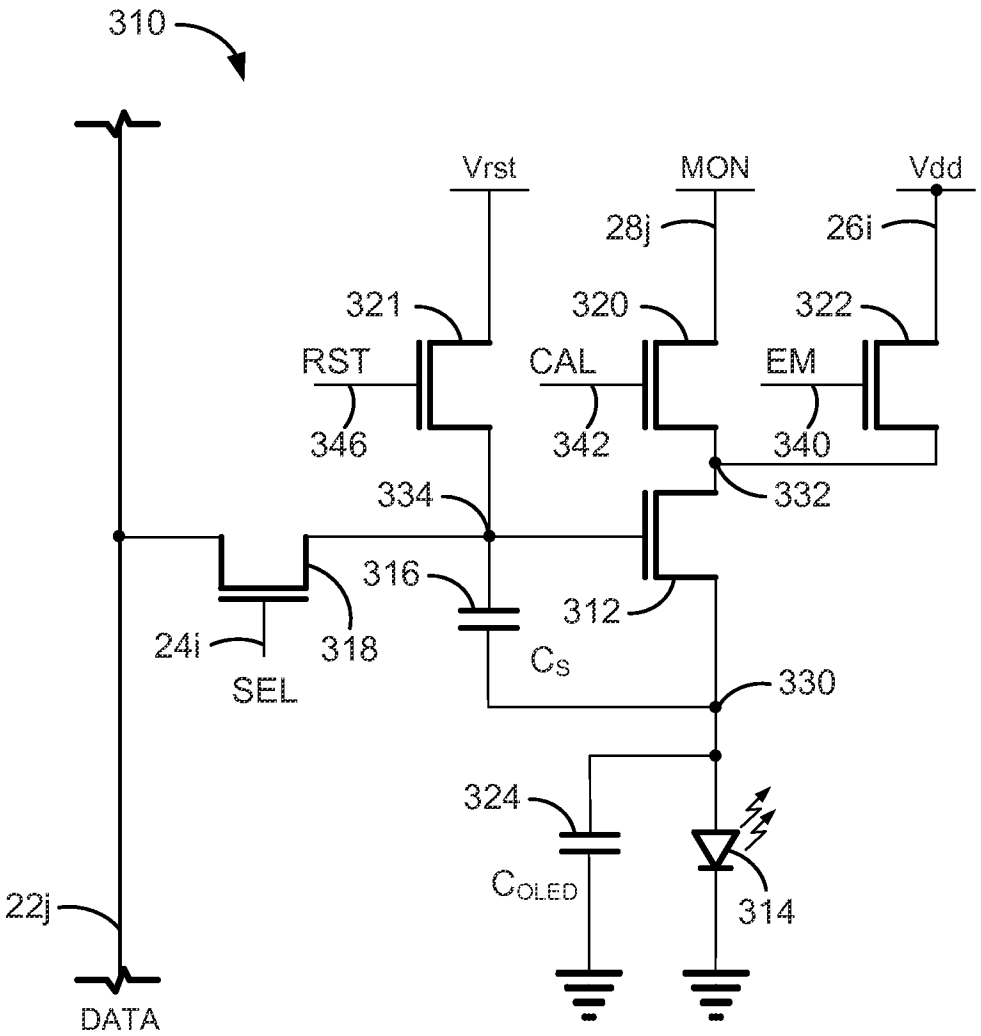
FIG. 6A is a circuit diagram of an exemplary pixel circuit configuration.

FIG. 6A is a circuit diagram of an exemplary driving circuit for a pixel 310 that includes a calibration transistor 320 between the drain of the drive transistor 312 and a MON/Vref2 line 28*j* for controlling the application of a voltage Vref2 to the node 332, which is the drain of the drive transistor 312. The circuit in FIG. 6A also includes an emission transistor 322 between the drain of the drive transistor 312 and a VDD line 26*i*, for controlling the application of the voltage Vdd to the node 332. The drive transistor 312, the switching transistor 318, the reset transistor 321 and the OLED 214 are the same as described above in the circuit of FIG. 5A.

FIG. 6B is a schematic timing diagram of exemplary operation cycles for the pixel 310 shown in FIG. 6A. At the beginning of the cycle 352, the EM line goes low to turnoff the emission transistor 322 so that the voltage Vdd is not applied to the drain of the drive transistor 312. The emission transistor remains off during the second cycle 354, when the CAL line goes high to turn on the calibration transistor 320, which connects the MON/Vref2 line 28*j* to the node 332. This charges the node 332 to a voltage that is smaller that the ON voltage of the OLED. At the end of the cycle 354, the CAL line goes low to turn off the calibration transistor 320. Then during the next cycle 356, and the RST and EM successively go high to turn on transistors 321 and 322, respectively, to connect (1) the Vrst line to a node 334, which is the gate terminal of the storage capacitor 316 and (2) the VDD line 26*i* to the node 332. This turns on the drive transistor 312 to charge the node 330 to a voltage that is a function of Vt and other parameters of the drive transistor 312.

At the beginning of the next cycle 358 shown in FIG. 6B, the RST and EM lines go low to turn off the transistors 321 and 322, and then the SEL line goes high to turn on the switching transistor 318 to supply a programming voltage Vp to the gate of the drive transistor 312. The node 330 at the source terminal of the drive transistor 312 remains substantially the same because the capacitance $C_{OLED}$ of the OLED 314 is large. Thus, the gate-source voltage of the transistor 312 is a function of the mobility, Vt and other parameters of the drive transistor 312 and thus can compensate for all these parameters.

Figure 7B:
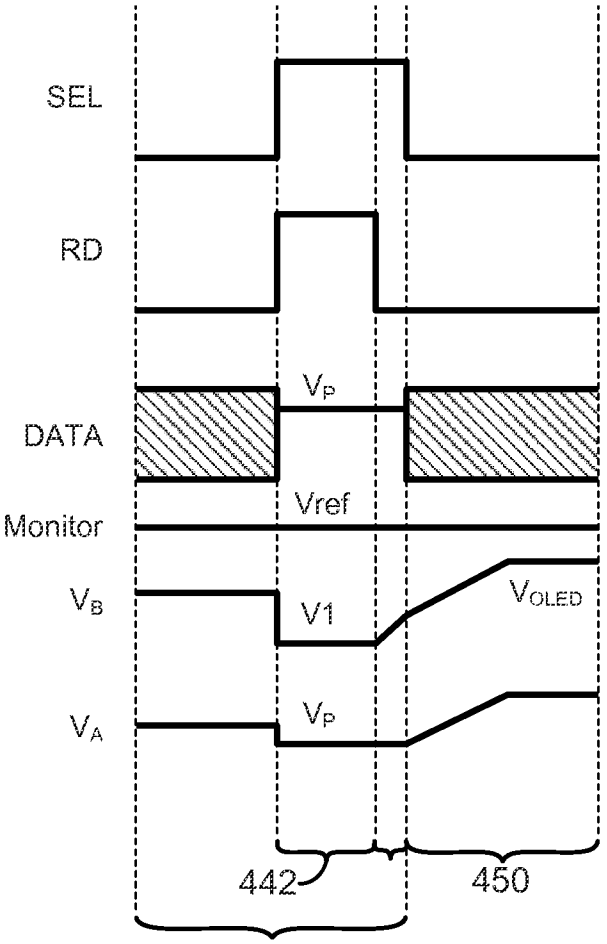
FIG. 7B is a timing diagram of exemplary operation cycles for the pixel illustrated in FIG. 7A.
Figure 7A:
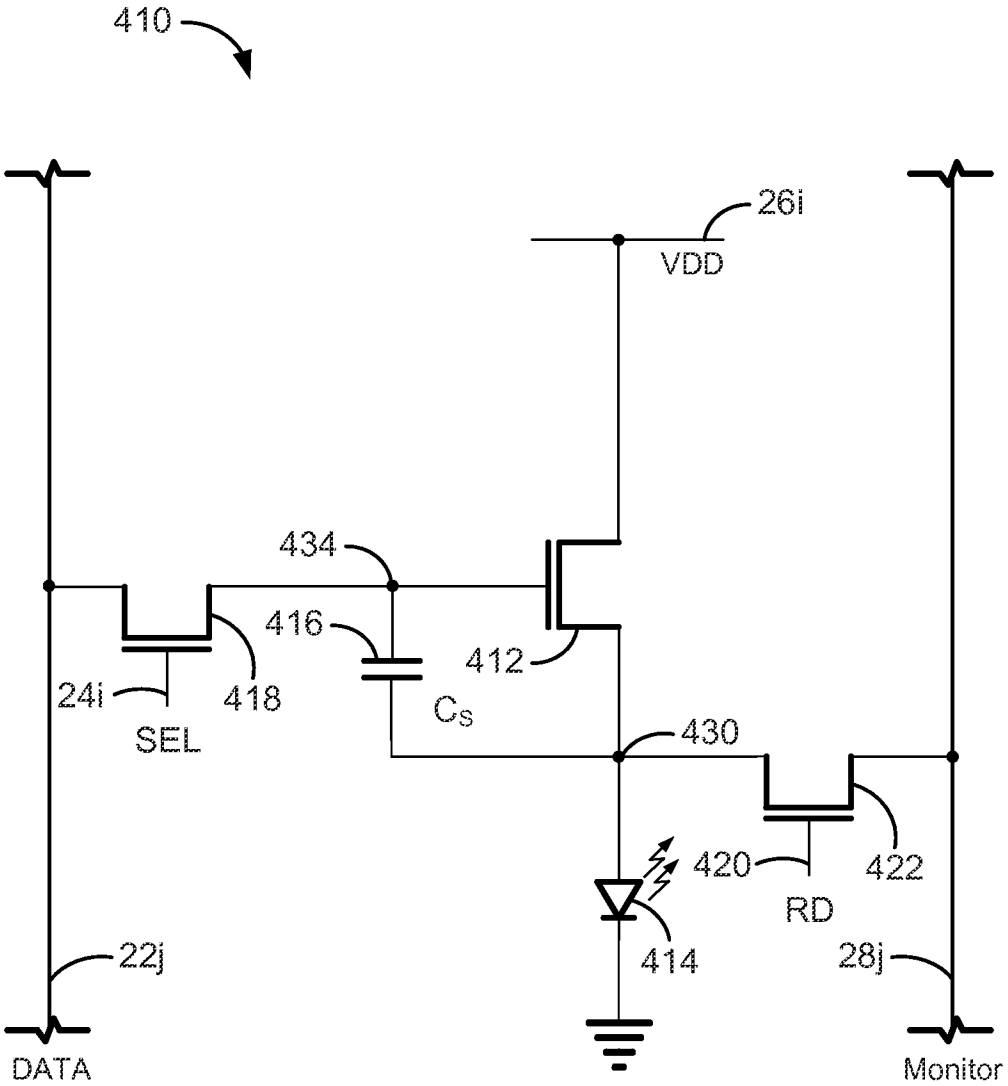
FIG. 7A is a circuit diagram of an exemplary pixel circuit configuration.

FIG. 7A is a circuit diagram of another exemplary driving circuit that modifies the gate-source voltage Vgs of the drive transistor 412 of a pixel 410 to compensate for variations in drive transistor parameters due to process variations, aging and/or temperature variations. This circuit includes a monitor line 28*j* coupled to the node 430 by a read transistor 422 controlled by a RD line 420, for reading the current values of operating parameters such as drive current and Voled. The drive transistor 412, the switching transistor 418 and the OLED 414 are the same as described above in the circuit of FIG. 2A.

FIG. 7B is a schematic timing diagram of exemplary operation cycles for the pixel 410 shown in FIG. 7A. At the beginning of the first phase 442 of a programming cycle 446, the SEL and RD lines both go high to (1) turn on a switching transistor 418 to charge the gate of the drive transistor 412 to a programming voltage Vp from the data line 22*j*, and (2) turn on a read transistor 422 to charge the source of the transistor 412 (node 430) to a voltage Vref from a monitor line 28*j*. During the second phase 444 of the programming cycle 446, the RD line goes low to turn off the read transistor 422 so that the node 430 is charged back through the transistor 412, which remains on because the SEL line remains high. Thus, the gate-source voltage of the transistor 312 is a function of the mobility, Vt and other parameters of the transistor 212 and thus can compensate for all these parameters.

Figure 8A:
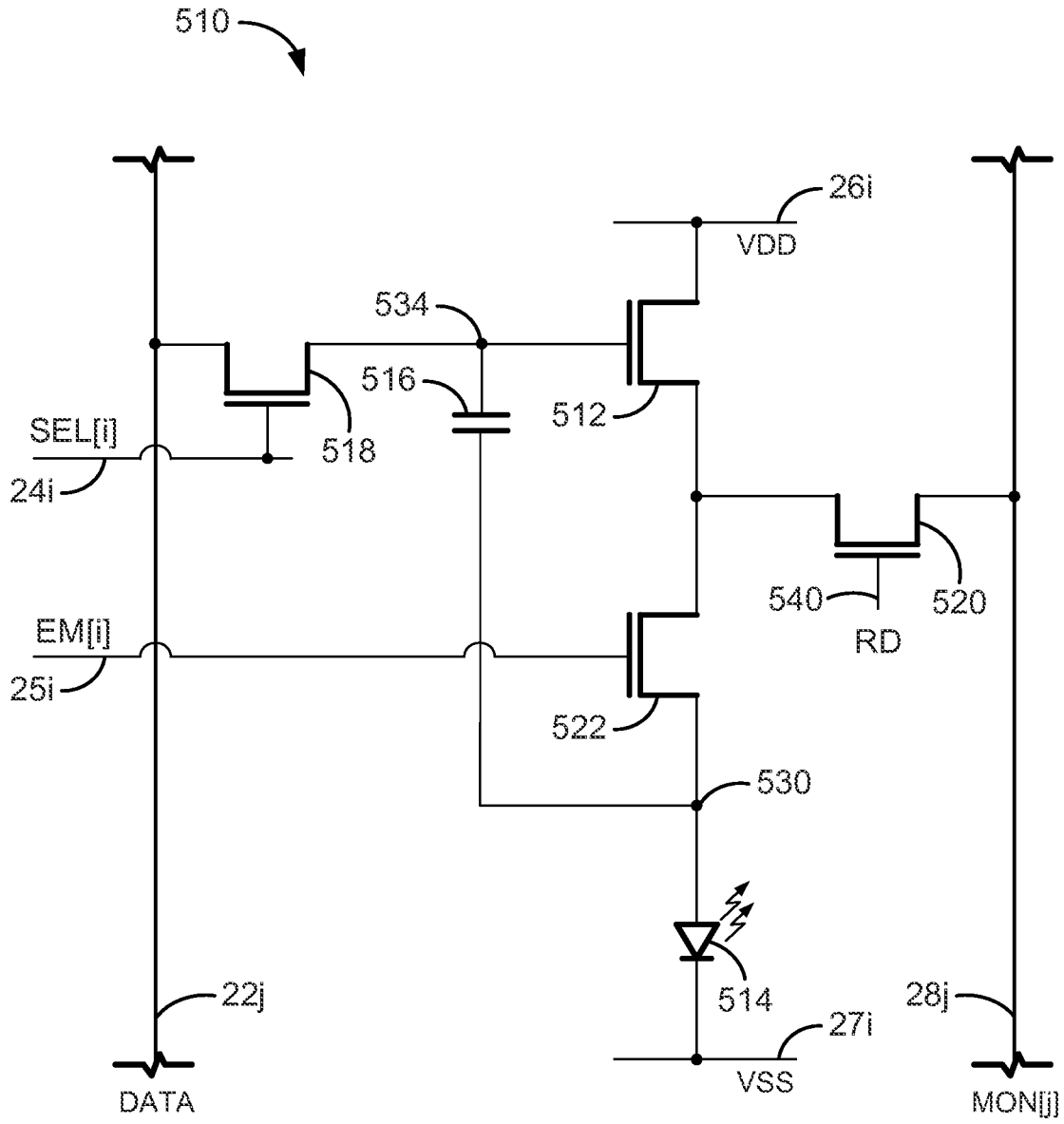
FIG. 8A is a circuit diagram of an exemplary pixel circuit configuration.

FIG. 8A is a circuit diagram of an exemplary driving circuit for a pixel 510 which adds an emission transistor 522 to the pixel circuit of FIG. 7A, between the source side of the storage capacitor 522 and the source of the drive transistor 512. The drive transistor 512, the switching transistor 518, the read transistor 520, and the OLED 414 are the same as described above in the circuit of FIG. 7A.

Figure 8B:
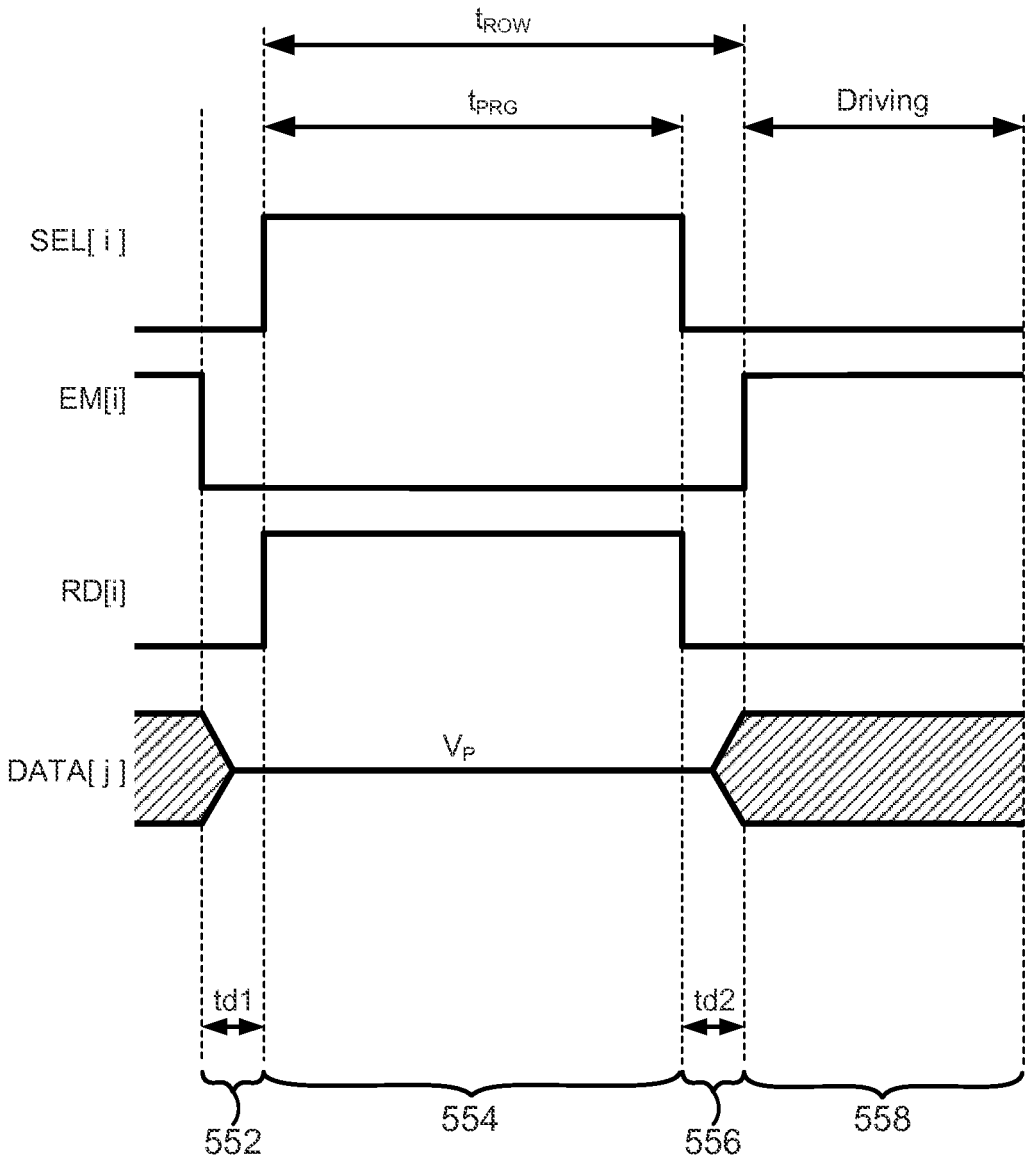
FIG. 8B is a timing diagram of exemplary operation cycles for the pixel illustrated in FIG. 8A.

FIG. 8B is a schematic timing diagram of exemplary operation cycles for the pixel 510 shown in FIG. 8A. As can be seen in FIG. 8B, the EM line is low to turn off the emission transistor 522 during the entire programming cycle 554, to produce a black frame. The emission transistor is also off during the entire measurement cycle controlled by the RD line 540, to avoid unwanted effects from the OLED 514. The pixel 510 can be programmed with no in-pixel compensation, as illustrated in FIG. 8B, or can be programmed in a manner similar to that described above for the circuit of FIG. 2A.

Figure 9A:
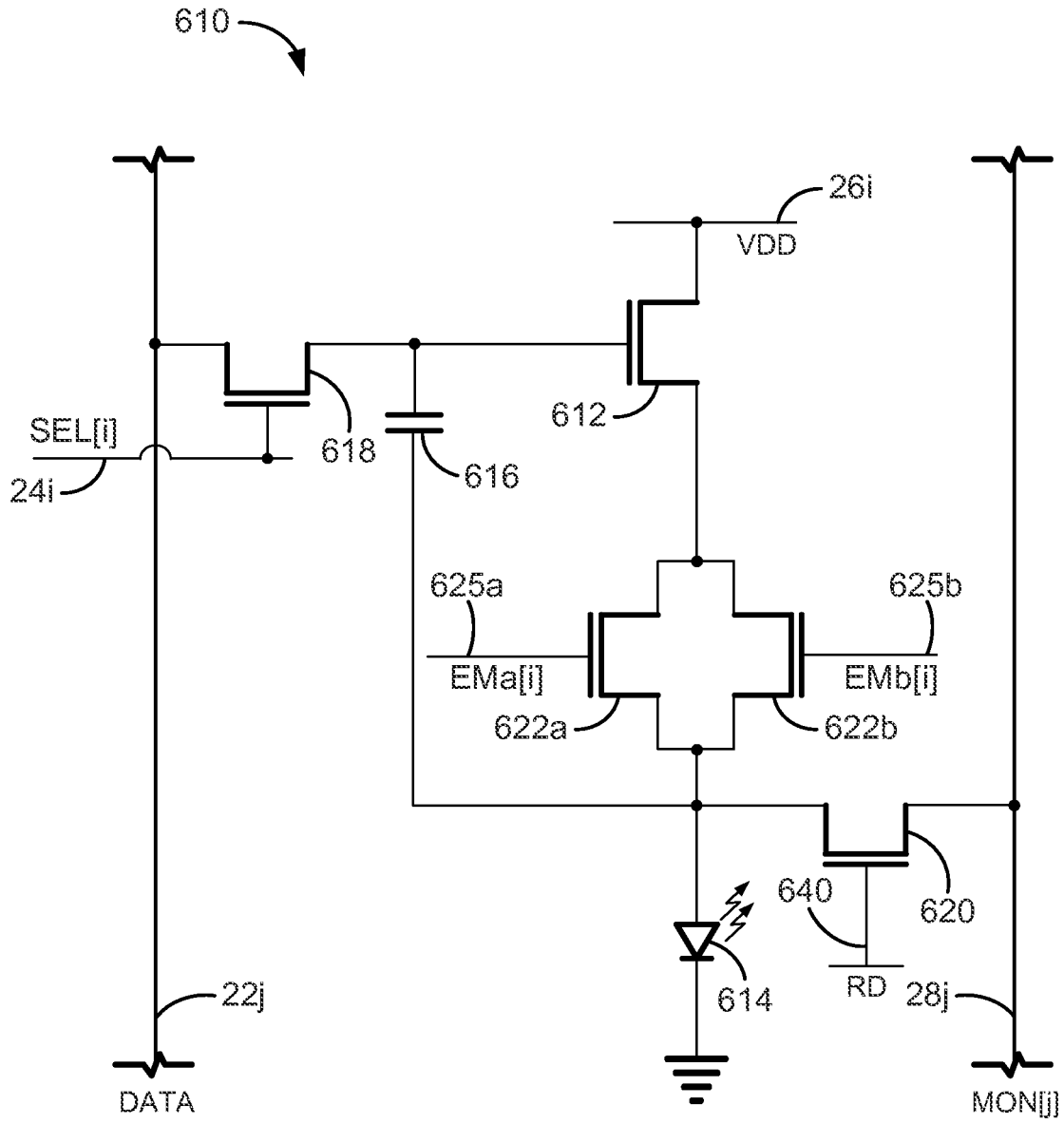
FIG. 9A is a circuit diagram of an exemplary pixel circuit configuration.
Figure 9B:
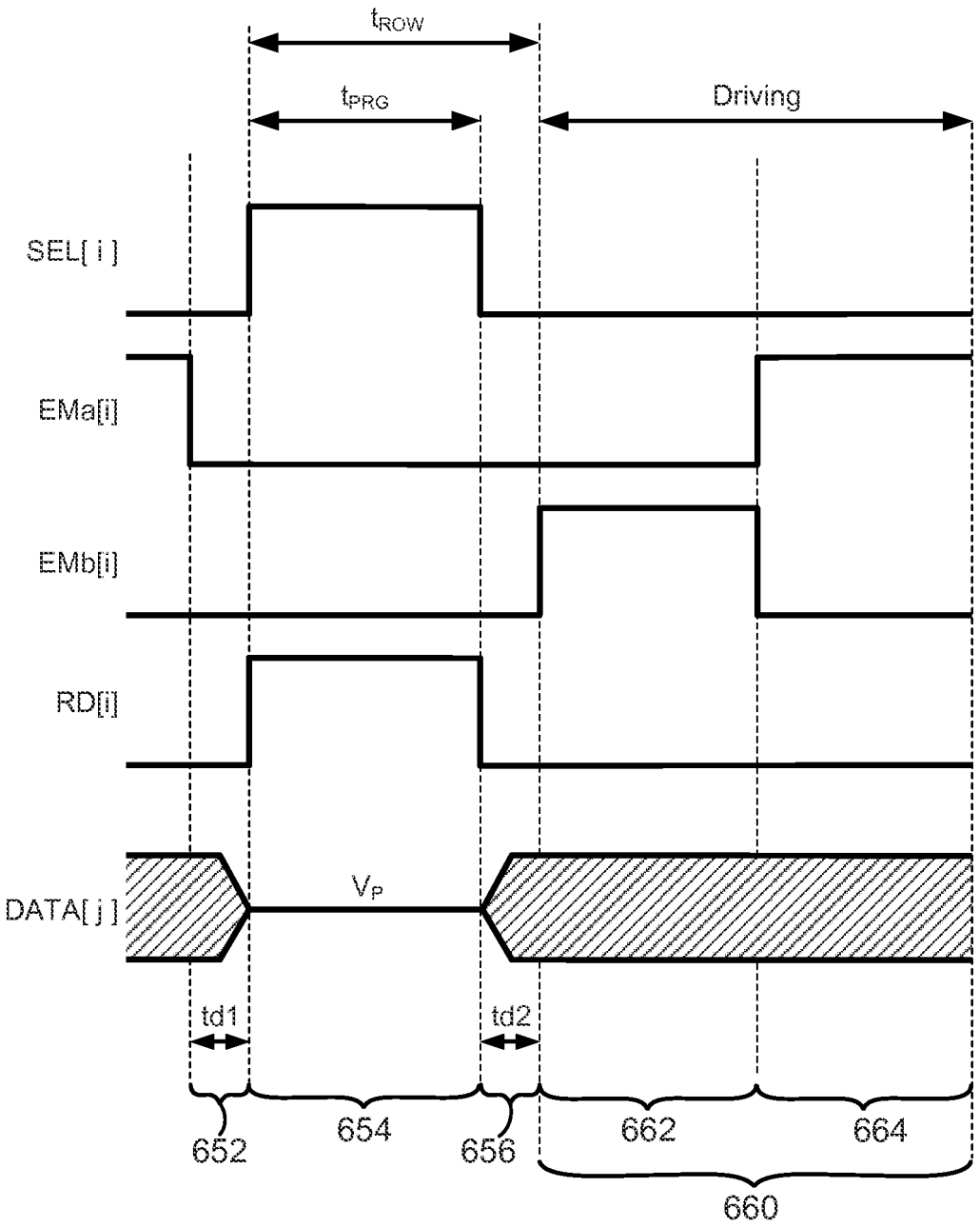
FIG. 9B is a timing diagram of first exemplary operation cycles for the pixel illustrated in FIG. 9A.
Figure 9C:
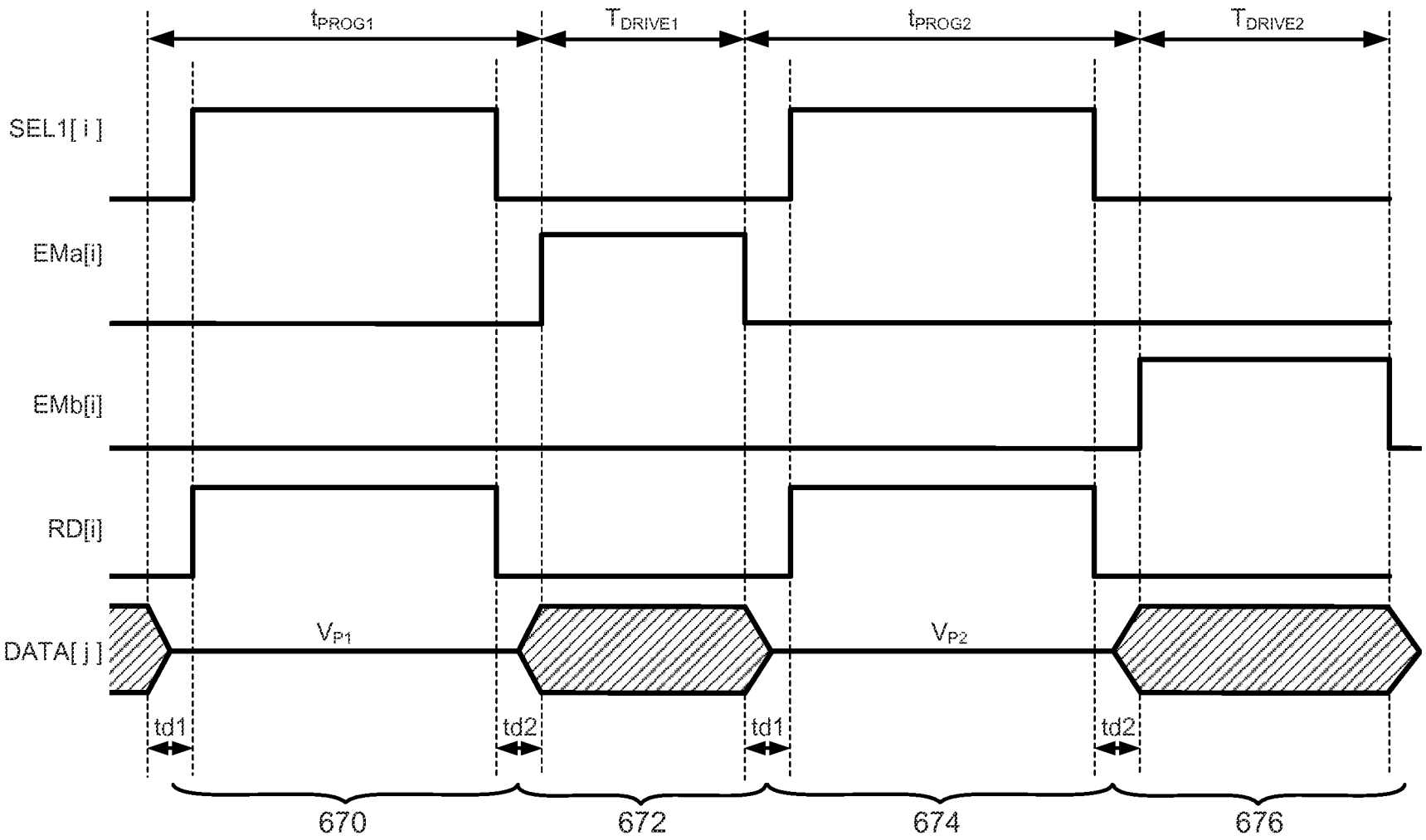
FIG. 9C is a timing diagram of second exemplary operation cycles for the pixel illustrated in FIG. 9A.

FIG. 9A is a circuit diagram of an exemplary driving circuit for a pixel 610 which is the same as the circuit of FIG. 8A except that the single emission transistor is replaced with a pair of emission transistors 622*a* and 622*b* connected in parallel and controlled by two different EM lines EMa and EMb. The two emission transistors can be used alternately to manage the aging of the emission transistors, as illustrated in the two timing diagrams in FIGS. 9B and 9C. In the timing diagram of FIG. 9B, the EMa line is high and the EMAb line is low during the first phase of a driving cycle 660, and then the EMa line is low and the EMAb line is high during the second phase of that same driving cycle. In the timing diagram of FIG. 9C, the EMa line is high and the EMAb line is low during a first driving cycle 672, and then the EMa line is low and the EMAb line is high during a second driving cycle 676.

Figure 10A:
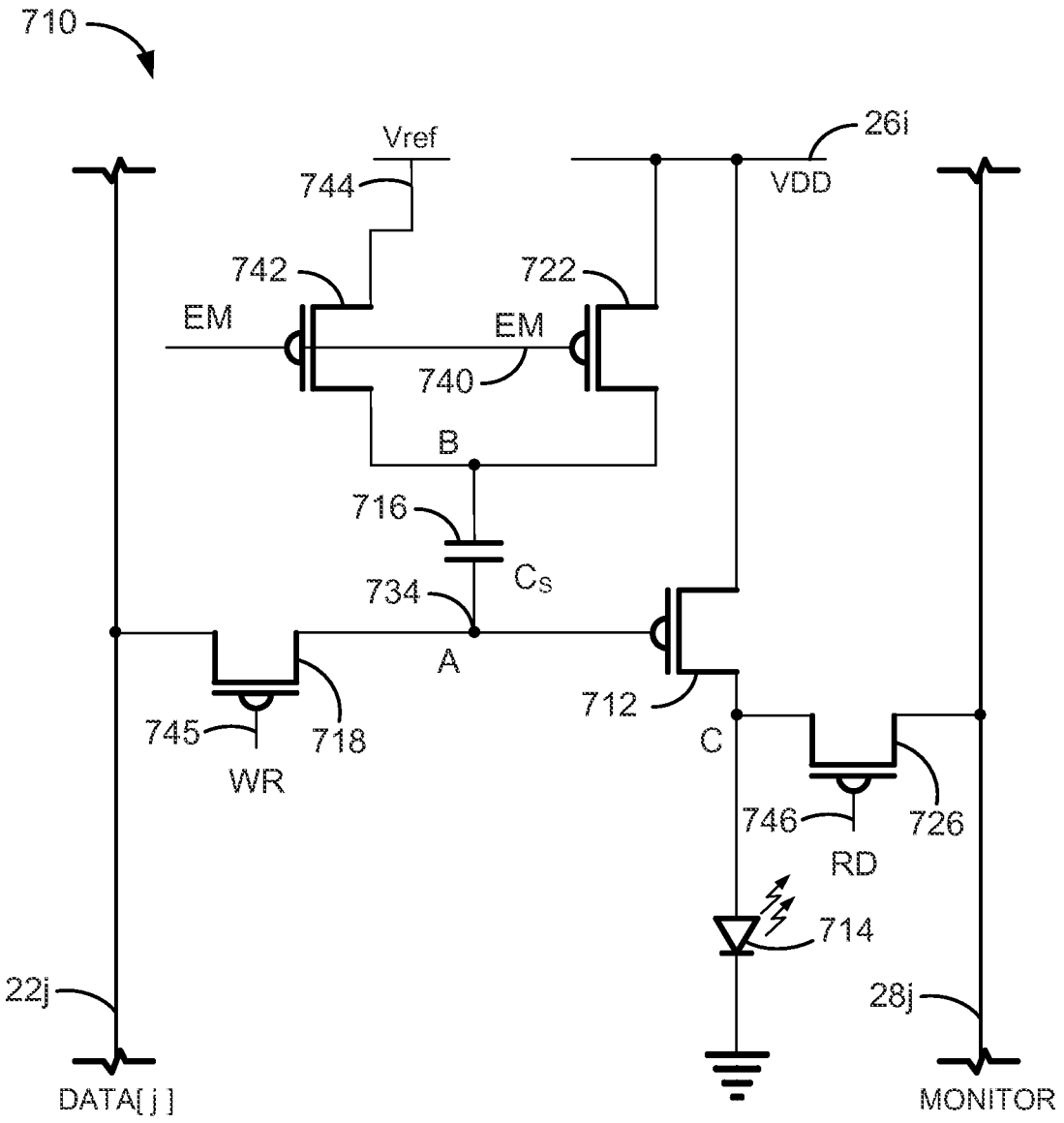
FIG. 10A is a circuit diagram of an exemplary pixel circuit configuration.

FIG. 10A is a circuit diagram of an exemplary driving circuit for a pixel 710 which is similar to the circuit of FIG. 3A described above, except that the circuit in FIG. 10A adds a monitor line 28*j*, the EM line controls both the Vref transistor 742 and the emission transistor 722, and the drive transistor 712 and the emission transistor 722 have separate connections to the VDD line. The drive transistor 12, the switching transistor 18, the storage capacitor 716, and the OLED 414 are the same as described above in the circuit of FIG. 3A.

Figure 10B:
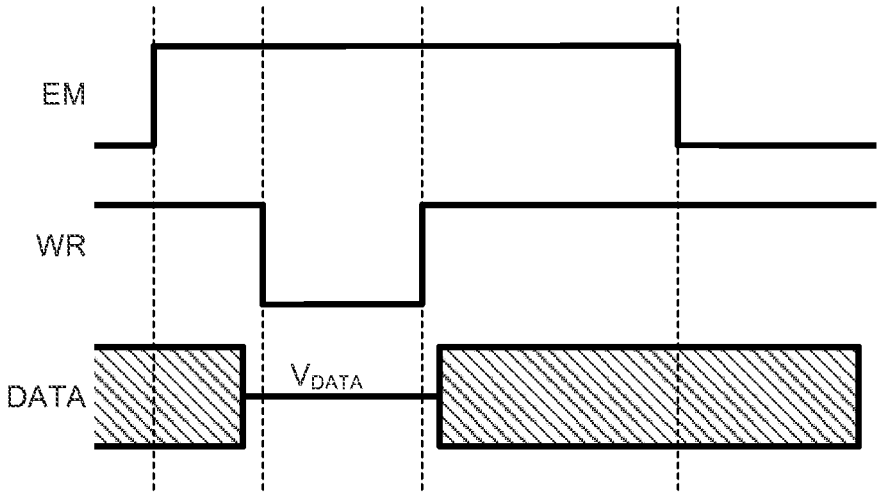
FIG. 10B is a timing diagram of exemplary operation cycles for the pixel illustrated in FIG. 10A in a programming cycle.

As can be seen in the timing diagram in FIG. 10B, the EM line 740 goes high and remains high during the programming cycle to turn off the p-type emission transistor 722. This disconnects the source side of the storage capacitor 716 from the VDD line 26*i* to protect the pixel 710 from fluctuations in the VDD voltage during the programming cycle, thereby avoiding any effect of VDD variations on the pixel current. The high EM line also turns on the n-type reference transistor 742 to connect the source side of the storage capacitor 716 to the Vrst line 744, so the capacitor terminal B is charged to Vrst. The gate voltage of the drive transistor 712 is high, so the drive transistor 712 is off. The voltage on the gate side of the capacitor 716 is controlled by the WR line 745 connected to the gate of the switching transistor 718 and, as shown in the timing diagram, the WR line 745 goes low during a portion of the programming cycle to turn on the p-type transistor 718, thereby applying the programming voltage Vp to the gate of the drive transistor 712 and the gate side of the storage capacitor 716.

When the EM line 740 goes low at the end of the programming cycle, the transistor 722 turns on to connect the capacitor terminal B to the VDD line. This causes the gate voltage of the drive transistor 712 to go to Vdd−Vp, and the drive transistor turns on. The charge on the capacitor is Vrst−Vdd−Vp. Since the capacitor 716 is connected to the VDD line during the driving cycle, any fluctuations in Vdd will not affect the pixel current.

Figure 10C:
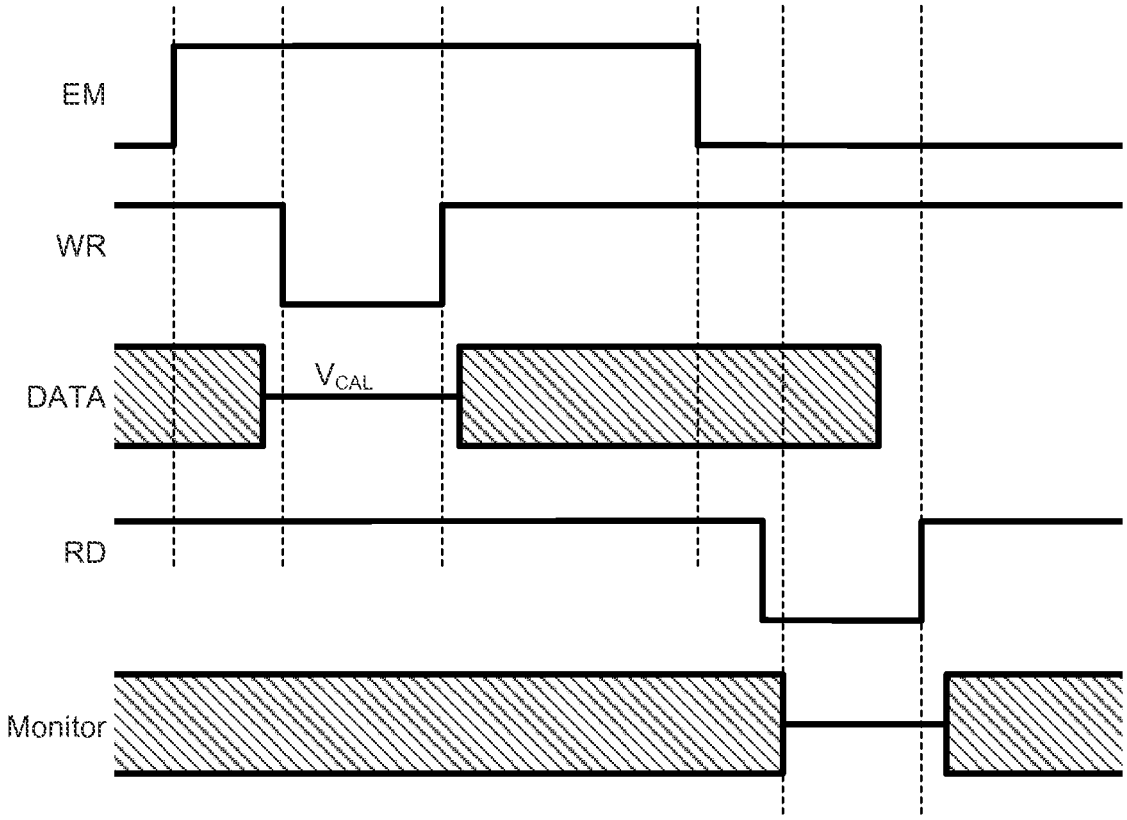
FIG. 10C is a timing diagram of exemplary operation cycles for the pixel illustrated in FIG. 10A in a TFT read cycle.

FIG. 10C is a timing diagram for a TFT read operation, which takes place during an interval when both the RD and EM lines are low and the WR line is high, so the emission transistor 722 is on and the switching transistor 718 is off. The monitor line 28*j* is connected to the source of the drive transistor 712 during the interval when the RD line 746 is low to turn on the read transistor 726, which overlaps the interval when current if flowing through the drive transistor to the OLED 714, so that a reading of that current flowing through the drive transistor 712 can be taken via the monitor line 28*j*.

Figure 10D:
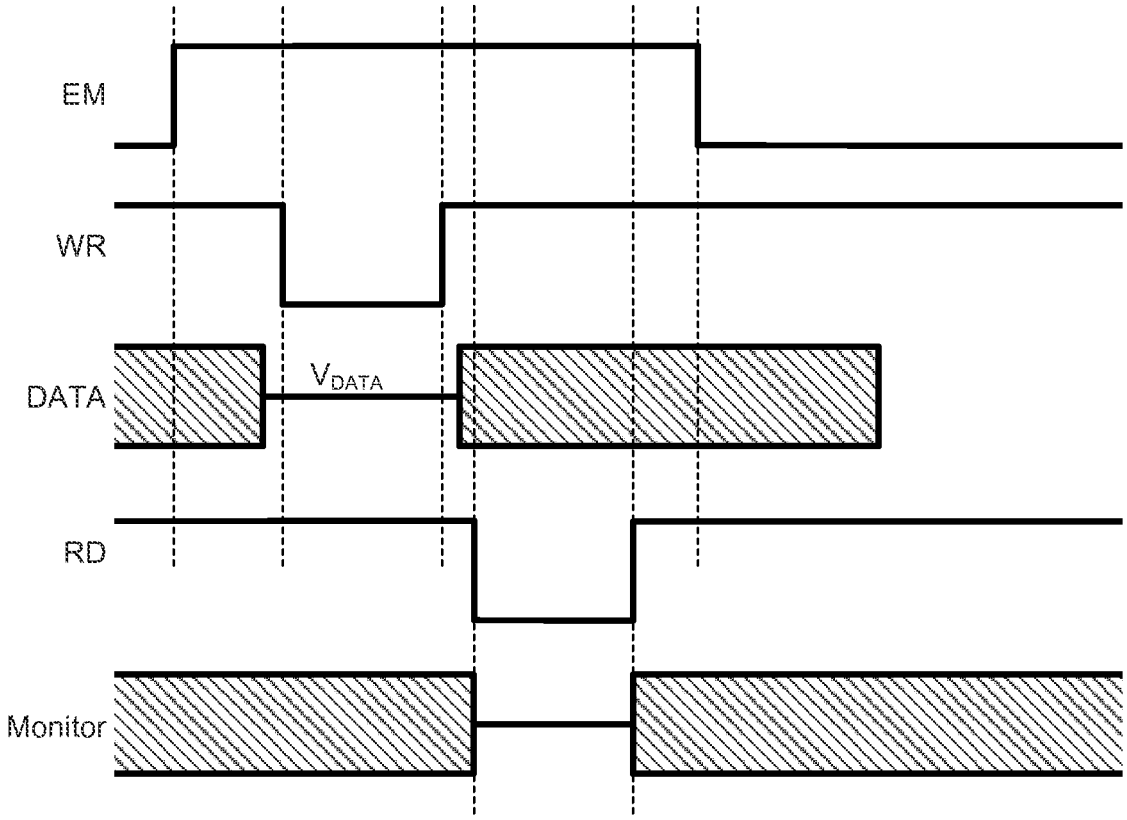
FIG. 10D is a timing diagram of exemplary operation cycles for the pixel illustrated in FIG. 10A in am OLED read cycle.

FIG. 10D is a timing diagram for an OLED read operation, which takes place during an interval when the RD line 746 is low and both the EM and WR lines are high, so the emission transistor 722 and the switching transistor 718 are both off. The monitor line 28*j* is connected to the source of the drive transistor 712 during the interval when the RD line is low to turn on the read transistor 726, so that a reading of the voltage on the anode of the OLED 714 can be taken via the monitor line 28*j*.

Figure 11A:
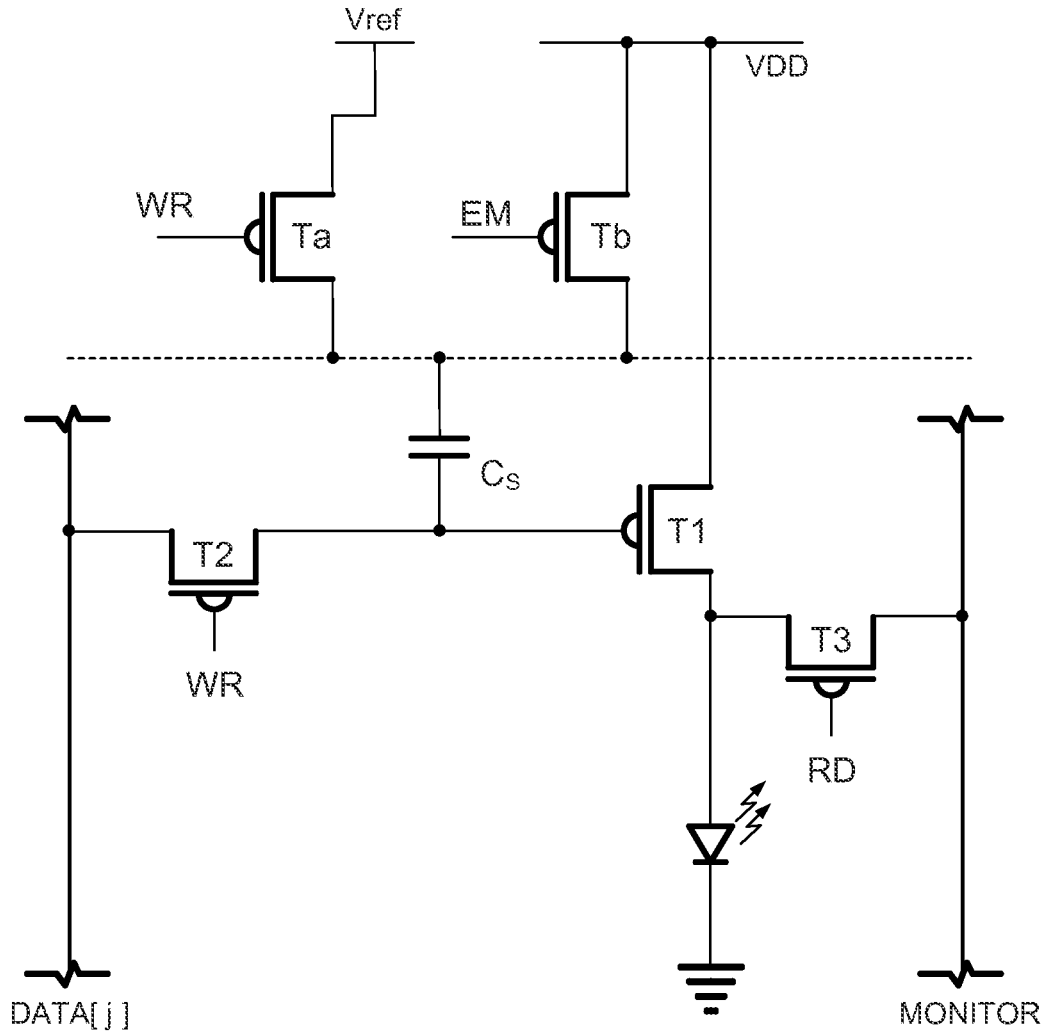
FIG. 11A is a circuit diagram of a pixel circuit with IR drop compensation.

FIG. 11A is a schematic circuit diagram of a pixel circuit with IR drop compensation. The voltages Vmonitor and Vdata are shown being supplied on two separate lines, but both these voltages can be supplied on the same line in this circuit, since Vmonitor has no role during the programming and Vdata has no role during the measurement cycle. The two transistors Ta and Tb can be shared between rows and columns for supplying the voltages Vref and Vdd, and the control signal EM can be shared between columns.

Figure 11B:
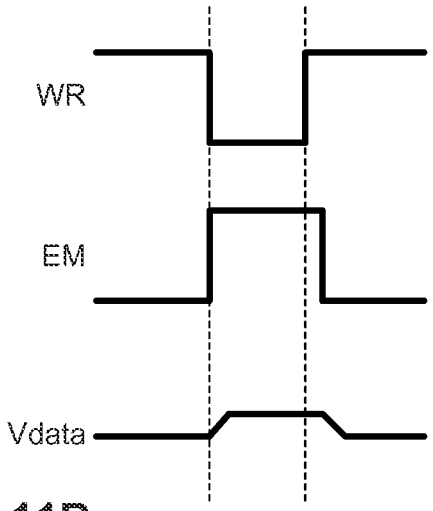
FIG. 11B is a timing diagram for an IR drop compensation operation of the circuit of FIG. 11A.

As depicted by the timing diagram in FIG. 11B, during normal operation of the circuit of FIG. 11A, the control signal WR turns on transistors T2 and Ta to supply the programming data Vp and the reference voltage Vref to opposite sides of the storage capacitor Cs, while the control signal EM turns off the transistor Tb. Thus the voltage stored in CS is Vref−Vp. During the driving cycle, the signal EM turns on the transistor Tb, and the signal WR turns off transistors T2 and Ta. Thus, the gate-source voltage of becomes Vref−Vp and independent of Vdd.

Figure 11C:
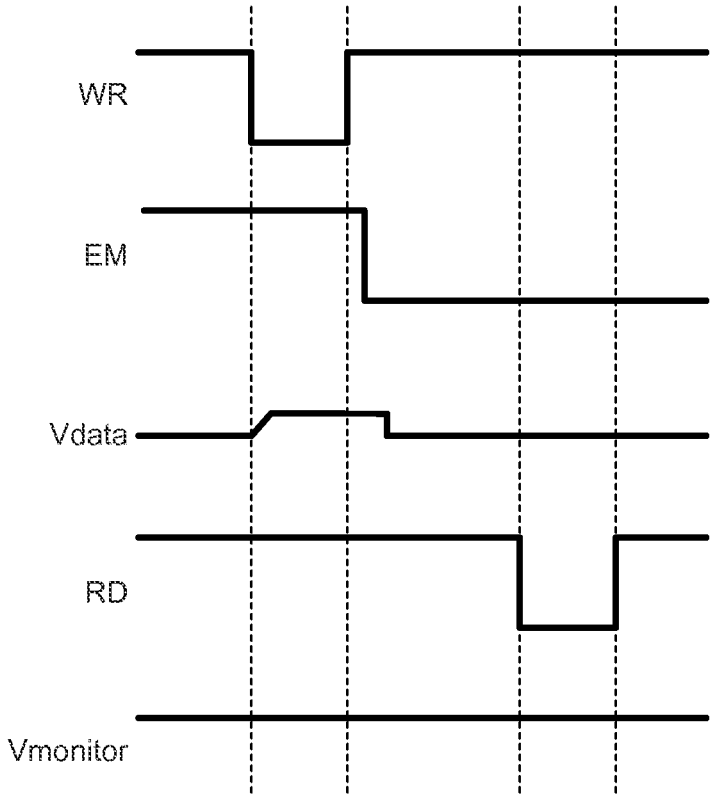
FIG. 11C is a timing diagram for reading out a parameter of the drive transistor in the circuit of FIG. 11A.

FIG. 11C is a timing diagram for obtaining a direct readout of parameters of the transistor T1 in the circuit of FIG. 11A. In a first cycle, the control signal WR turns on the transistor T2 and the pixel is programmed with a calibrated voltage Vdata for a known target current. During the second cycle, the control signal RD turns on the transistor T3, and the pixel current is read through the transistor T3 and the line Vmonitor. The voltage on the Vmonitor line is low enough during the second cycle to prevent the OLED from turning on. The calibrated voltage is then modified until the pixel current becomes the same as the target current. The final modified calibrated voltage is then used as a point in TFT current-voltage characteristics to extract the corresponding current through the transistor T1. Alternatively, a current can be supplied through the Vmonitor line and the transistor T3 while the transistors T2 and Ta are turned on, and Vdata is set to a fixed voltage. At this point the voltage created on the line Vmonitor is the gate voltage of the transistor T1 for the corresponding current.

Figure 11D:
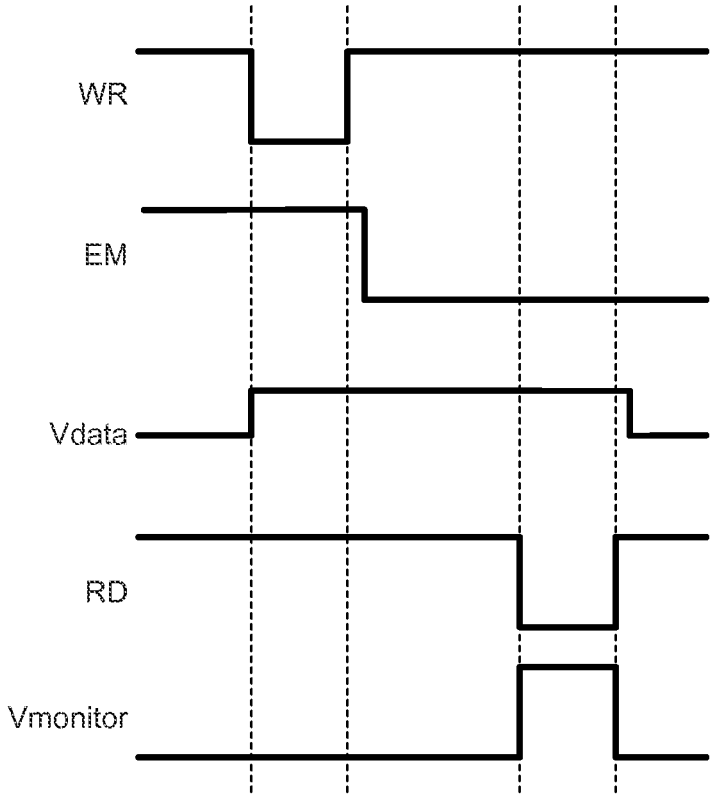
FIG. 11D is a timing diagram for reading out a parameter of the light emitting device in the circuit of FIG. 11A.

FIG. 11D is a timing diagram for obtaining a direct readout of the OLED voltage in the circuit of FIG. 11A. In the first cycle, the control signal WR turns on the transistor T2, and the pixel is programmed with an off voltage so that the drive transistor T1 does not provide any current. During the second cycle, the control signal RD turns on the transistor T3 so the OLED current can be read through the Vmonitor line. The Vmonitor voltage is pre-calibrated based for a known target current. The Vmonitor voltage is then modified until the OLED current becomes the same as the target current. Then the modified Vmonitor voltage is used as a point in the OLED current-voltage characteristics to extract a parameter of the OLED, such as its turn-on voltage.

The control signal EM can keep the transistor Tb turned off all the way to the end of the readout cycle, while the control signal WR keeps the transistor Ta turned on. In this case, the remaining pixel operations for reading the OLED parameter are the same as described above for FIG. 11C.

Alternatively, a current can be supplied to the OLED through the Vmonitor line so that the voltage on the Vmonitor line is the gate voltage of the drive transistor T1 for the corresponding current.

Figure 12A:
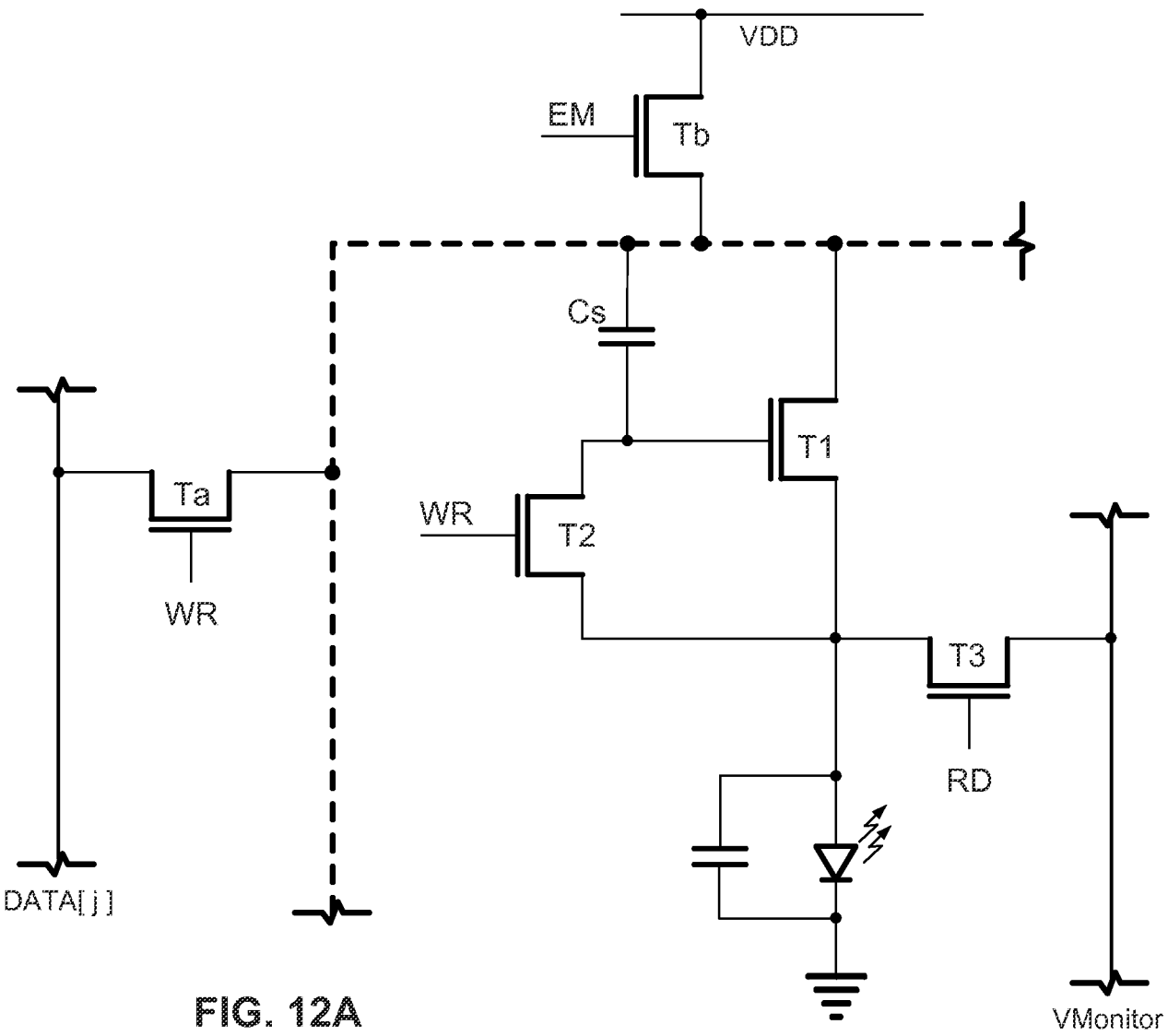
FIG. 12A is a circuit diagram of a pixel circuit with charge-based compensation.

FIG. 12A is a schematic circuit diagram of a pixel circuit with charge-based compensation. The voltages Vmonitor and Vdata are shown being supplied on the lines Vmonitor and Vdata, but Vmonitor can be Vdata as well, in which case Vdata can be a fixed voltage Vref. The two transistors Ta and Tb can be shared between adjacent rows for supplying the voltages Vref and Vdd, and Vmonitor can be shared between adjacent columns.

Figure 12B:
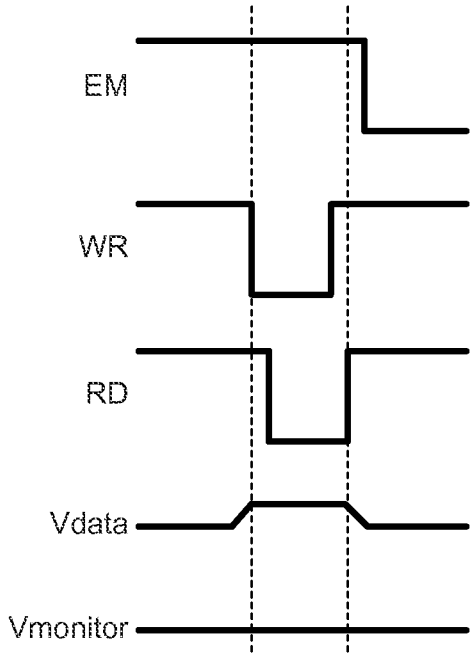
FIG. 12B is a timing diagram for a charge-based compensation operation of the circuit of FIG. 12A.

The timing diagram in FIG. 12B depicts normal operation of the circuit of FIG. 12A. The control signal WR turns on the respective transistors Ta and T2 to apply the programming voltage Vp from the Vdata line to the capacitor Cs, and the control signal RD turns on the transistor T3 to apply the voltage Vref through the Vmonitor line and transistor T3 to the node between the drive transistor T1 and the OLED. Vref is generally low enough to prevent the OLED from turning on. As depicted in the timing diagram in FIG. 12B, the control signal RD turns off the transistor T3 before the control signal WR turns off the transistors Ta and T2. During this gap time, the drive transistor T1 starts to charge the OLED and so compensates for part of the variation of the transistor T1 parameter, since the charge generated will be a function of the T1 parameter. The compensation is independent of the IR drop since the source of the drive transistor T1 is disconnected from Vdd during the programming cycle.

Figure 12C:
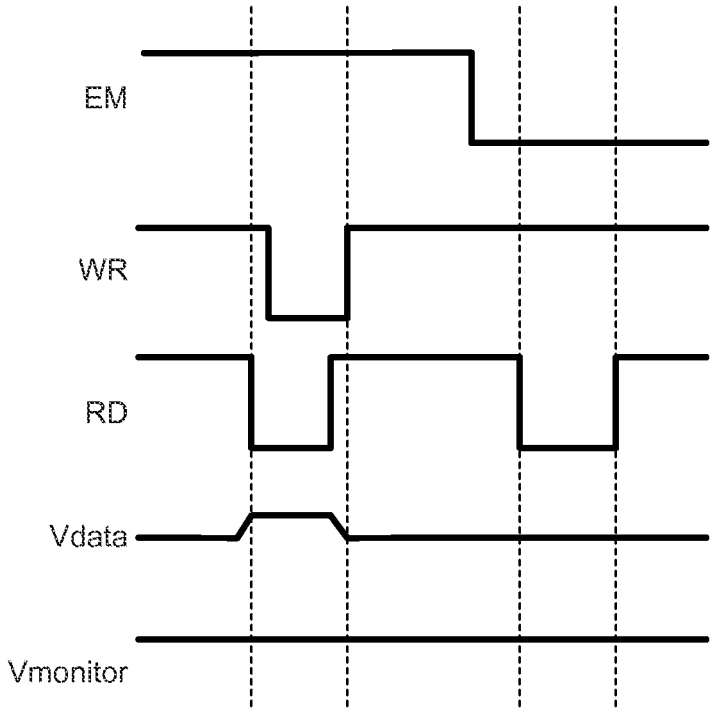
FIG. 12C is a timing diagram for a direct readout of a parameter of the light emitting device in the circuit of FIG. 12A.

The timing diagram in FIG. 12C depicts a direct readout of a parameter of the drive transistor T1 in the circuit of FIG. 12A. In the first cycle, the circuit is programmed with a calibrated voltage for a known target current. During the second cycle, the control signal RD turns on the transistor T3 to read the pixel current through the Vmonitor line. The Vmonitor voltage is low enough during the second cycle to prevent the OLED from turning on. Next, the calibrated voltage is varied until the pixel current becomes the same as the target current. The final value of the calibrated voltage is used as a point in the current-voltage characteristics of the drive transistor T1 to extract a parameter of that transistor. Alternatively, a current can be supplied to the OLED through the Vmonitor line, while the control signal WR turns on the transistor T2 and Vdata is set to a fixed voltage, so that the voltage on the Vmonitor line is the gate voltage of the drive transistor T1 for the corresponding current.

Figure 12D:
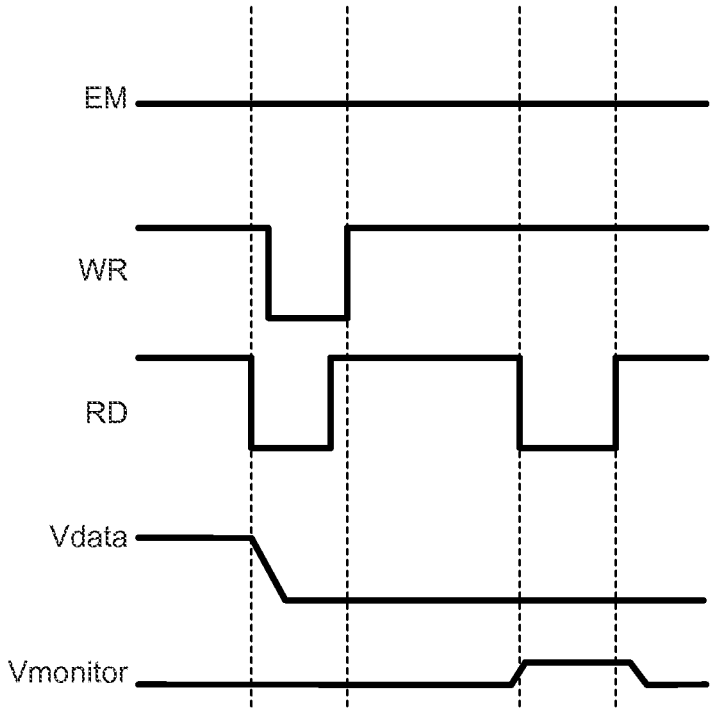
FIG. 12D is a timing diagram for an indirect readout of a parameter of the light emitting device in the circuit of FIG. 12A.

The timing diagram in FIG. 12D depicts a direct readout of a parameter of the OLED in the circuit of FIG. 12A. In the first cycle, the circuit is programmed with an off voltage so that the drive transistor T1 does not provide any current. During the second cycle, the control signal RD turns on the transistor T3, and the OLED current is read through the Vmonitor line. The Vmonitor voltage during second cycle is pre-calibrated, based for a known target current. Then the Vmonitor voltage is varied until the OLED current becomes the same as the target current. The final value of the Vmonitor voltage is then used as a point in the current-voltage characteristics of the OLED to extracts a parameter of the OLED. One can extend the EM off all the way to the end of the readout cycle and keep the WR active. In this case, the remaining pixel operations for reading OLED will be the same as previous steps. One can also apply a current to the OLED through Vmonitor. At this point the created voltage on Vmonitor is the TFT gate voltage for the corresponding current.

Figure 12E:
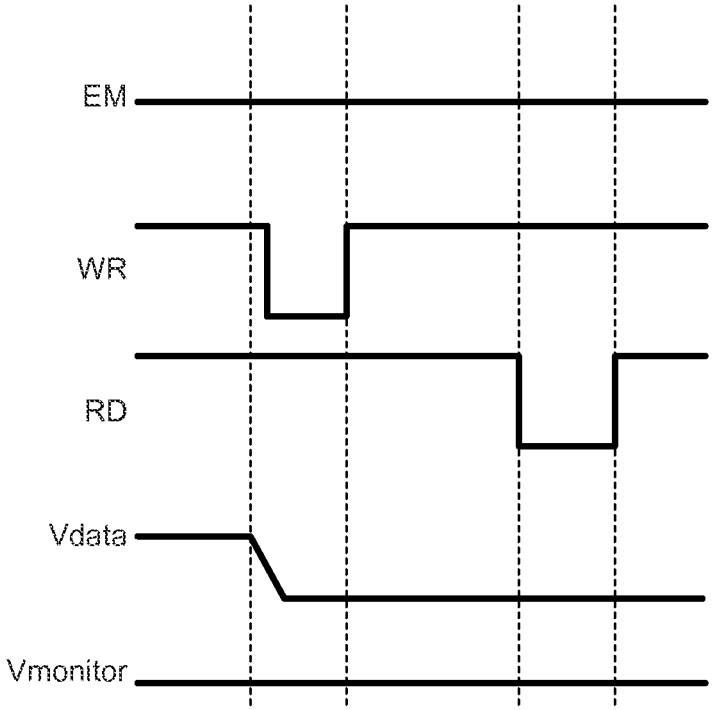
FIG. 12E is a timing diagram for a direct readout of a parameter of the drive transistor in the circuit of FIG. 12A.

The timing diagram in FIG. 12E depicts an indirect readout of a parameter of the OLED in the circuit of FIG. 12A. Here the pixel current is read out in a manner similar to that described above for the timing diagram of FIG. 12C. The only difference is that during the programming, the control signal RD turns off the transistor T3, and thus the gate voltage of the drive transistor T1 is set to the OLED voltage. Thus, the calibrated voltage needs to account for the effect of the OLED voltage and the parameter of the drive transistor T1 to make the pixel current equal to the target current. This calibrated voltage and the voltage extracted by the direct T1 readout can be used to extract the OLED voltage. For example, subtracting the calibrated voltage extracted from this process with the calibrated voltage extracted from TFT direct readout will result to the effect of OLED if the two target currents are the same.

Figure 13:
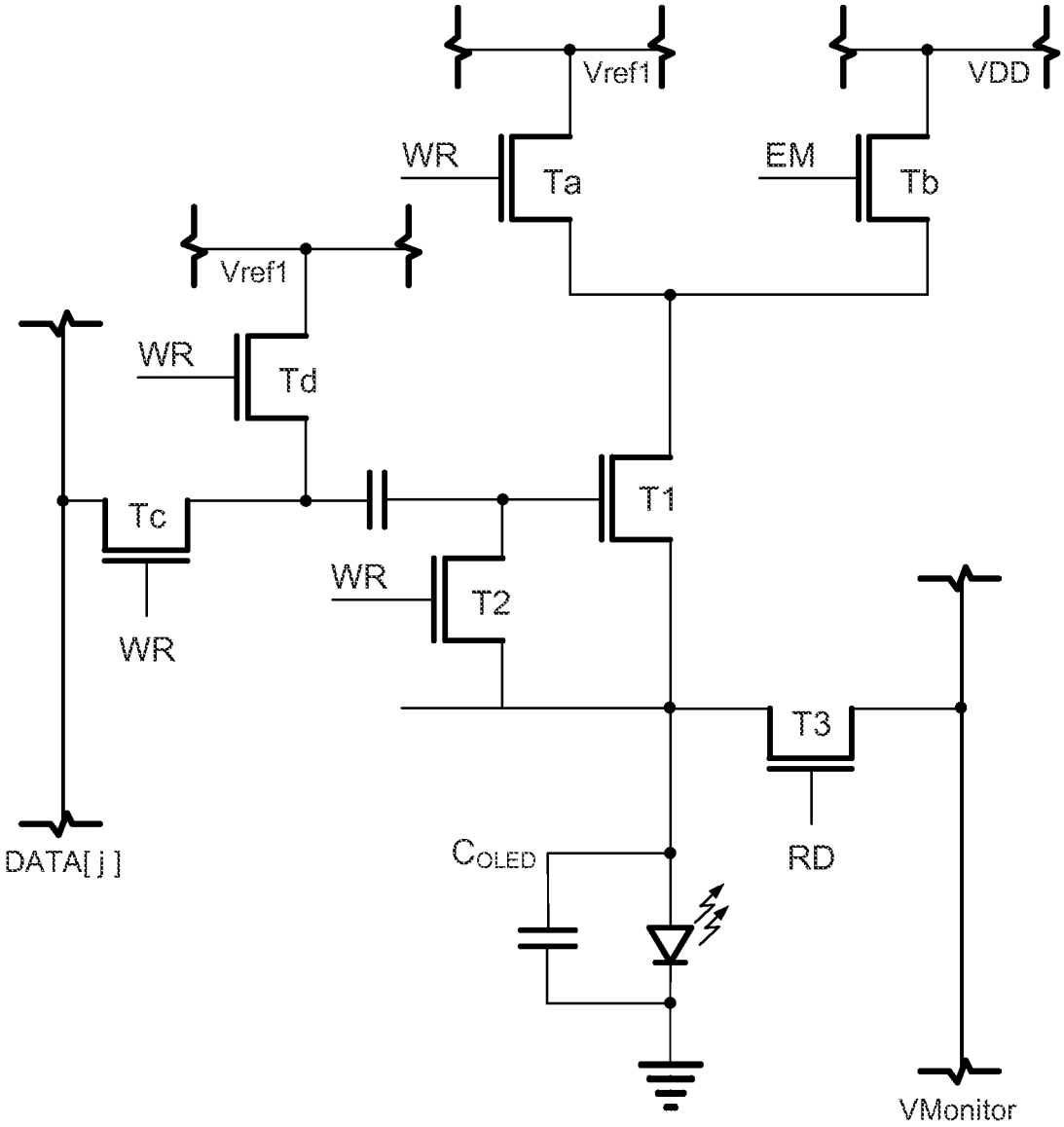
FIG. 13 is a circuit diagram of a biased pixel circuit.

FIG. 13 is a schematic circuit diagram of a biased pixel circuit with charge-based compensation. The two transistors Ta and Tb can be shared between adjacent rows and columns for supplying the voltages Vdd and Vref1, the two transistors Tc and Td can be shared between adjacent rows for supplying the voltages Vdata and Vref2, and the Vmonitor line can be shared between adjacent columns.

In normal operation of the circuit of FIG. 13, the control signal WR turns on the transistors Ta, Tc and T2, the control signal RD turns on the transistor T3, and the control signal EM turns off the transistor Tb and Td. The voltage Vref2 can be Vdata. The Vmonitor line is connected to a reference current, and the Vdata line is connected to a programming voltage from the source driver. The gate of the drive transistor T1 is charged to a bias voltage related to the reference current from the Vmonitor line, and the voltage stored in the capacitor Cs is a function of the programming voltage Vp and the bias voltage. After programming, the control signals WR and Rd turn off the transistors Ta, Tc, T2 and T3, and EM turns on the transistor Tb. Thus, the gate-source voltage of the transistor T1 is a function of the voltage Vp and the bias voltage. Since the bias voltage is a function of parameters of the transistor T1, the bias voltage becomes insensitive to variations in the transistor T1. In the same operation, the voltages Vref1 and Vdata can be swapped, and the capacitor Cs can be directly connected to Vdd or Vref, so there is no need for the transistors Tc and Td.

In another operating mode, the Vmonitor line is connected to a reference voltage. During the first cycle in this operation, the control signal WR turns on the transistors Ta, Tc and T2, the control signal RD turns on the transistor T3. Vdata is connected to Vp. During the second cycle of this operation, the control signal RD turns off the transistor T3, and so the drain voltage of the transistor T1 (the anode voltage of the OLED), starts to increase and develops a voltage VB. This change in voltage is a function of the parameters of the transistor T1. During the driving cycle, the control signals WR and RD turn off the transistors Ta, Tc, T2 and T3. Thus, the source gate-voltage of the transistor T1 becomes a function of the voltages Vp and VB. In this mode of operation, the voltages Vdata and Vref1 can be swapped, and Cs can be connected directly to Vdd or a reference voltage, so there is no need for the transistors Td and Tc.

For a direct readout of a parameter of the drive transistor T1, the pixel is programmed with one of the aforementioned operations using a calibrated voltage. The current of the drive transistor T1 is then measured or compared with a reference current. In this case, the calibrated voltage can be adjusted until the current through the drive transistor is substantially equal to a reference current. The calibrated voltage is then used to extract the desired parameter of the drive transistor.

For a direct readout of the OLED voltage, the pixel is programmed with black using one of the operations described above. Then a calibrated voltage is supplied to the Vmonitor line, and the current supplied to the OLED is measured or compared with a reference current. The calibrated voltage can be adjusted until the OLED current is substantially equal to a reference current. The calibrated voltage can then be used to extract the OLED parameters.

For an indirect readout of the OLED voltage, the pixel current is read out in a manner similar to the operation described above for the direct readout of parameters of the drive transistor T1. The only difference is that during the programming, the control signal RD turns off the transistor T3, and thus the gate voltage of the drive transistor T1 is set to the OLED voltage. The calibrated voltage needs to account for the effect of the OLED voltage and the drive transistor parameter to make the pixel current equal to the target current. This calibrated voltage and the voltage extracted from the direct readout of the T1 parameter can be used to extract the OLED voltage. For example, subtracting the calibrated voltage extracted from this process from the calibrated voltage extracted from the direct readout of the drive transistor corresponds to the effect of the OLED if the two target currents are the same.

Figure 14B:
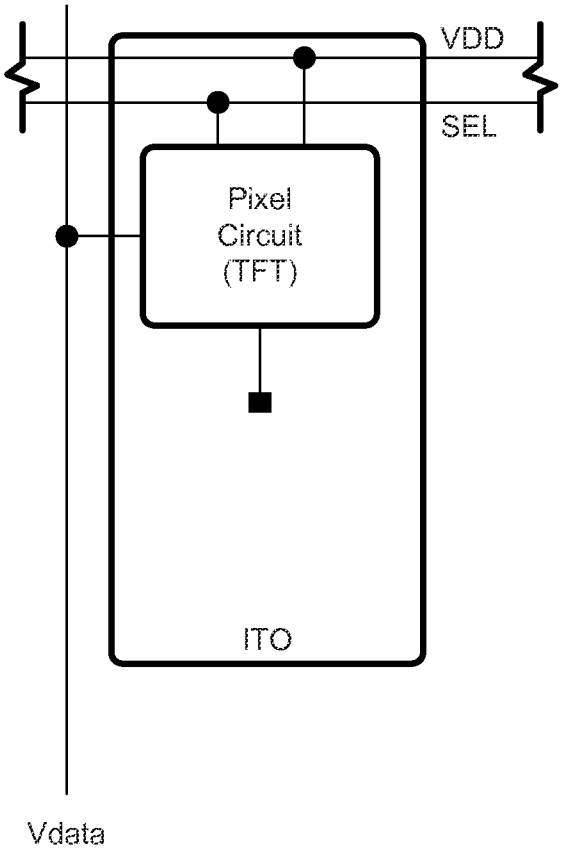
FIG. 14B is a diagram of a pixel circuit and an expanded electrode replacing the signal line shown in FIG. 14A.
Figure 14A:
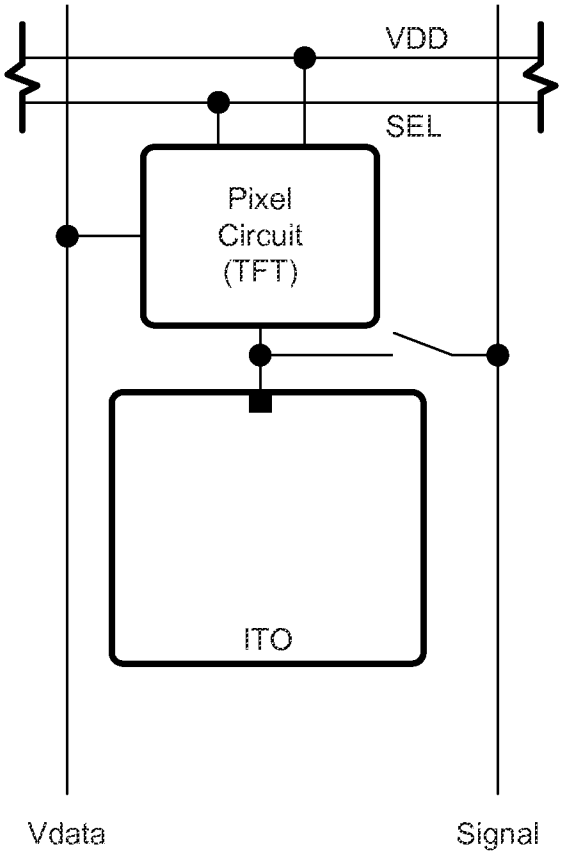
FIG. 14A is a diagram of a pixel circuit and an electrode connected to a signal line.

FIG. 14A illustrates a pixel circuit with a signal line connected to an OLED and the pixel circuit, and FIG. 14B illustrates the pixel circuit with an electrode ITO patterned as a signal line.

The same system used to compensate the pixel circuits can be used to analyze an entire display panel during different stages of fabrication, e.g., after backplane fabrication, after OLED fabrication, and after full assembly. At each stage the information provided by the analysis can be used to identify the defects and repair them with different techniques such as laser repair. To be able to measure the panel, there must be either a direct path to each pixel to measure the pixel current, or a partial electrode pattern may be used for the measurement path, as depicted in FIG. 14B. In the latter case, the electrode is patterned to contact the vertical lines first, and after the measurement is finished, the balance of the electrode is completed.

Figure 15:
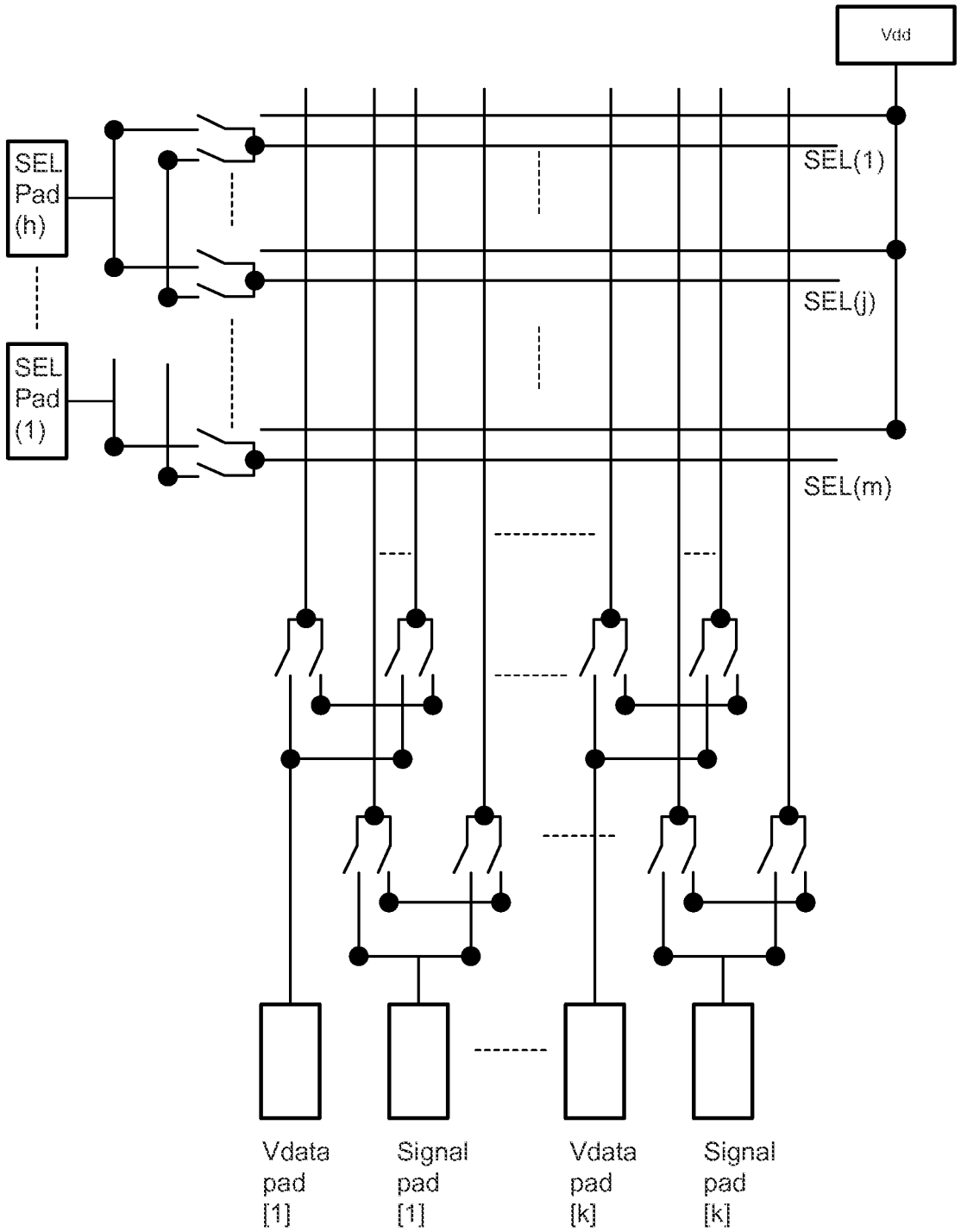
FIG. 15 is a circuit diagram of a pad arrangement for use in the probing of a display panel.

FIG. 15 illustrates a typical arrangement for a panel and its signals during a panel test, including a pad arrangement for probing the panel. Every other signal is connected to one pad through a multiplexer having a default stage that sets the signal to a default value. Every signal can be selected through the multiplexer to either program the panel or to measure a current, voltage and/or charge from the individual pixel circuits.

FIG. 16 illustrates a pixel circuit for use in testing. The following are some of the factory tests that can be carried out to identify defects in the pixel circuits. A similar concept can be applied to different pixel circuits, although the following tests are defined for the pixel circuit shown in FIG. 16.

Test #1:

WR is high (Data=high and Data=low and Vdd=high).

| | $I_{data_high} < I_{th_high}$ | $I_{data_high} > I_{th_high}$ |
|---|---|---|
| $I_{data_low} > I_{th_low}$ | NA | T1: short<br>‖ B: stock at high<br>(if data current is high, B is stock at high) |
| $I_{data_low} < I_{th_low}$ | T1: open<br>‖ T3: open | T1: OK<br>&& T2: ?<br>&& T3: OK |

Here, $I_{th_low}$ is the lowest acceptable current allowed for Data = low, and $I_{th_high}$ is the highest acceptable current for Data = high.

Test #2:

Static: WR is high (Data=high and Data=low).

Dynamic: WR goes high and after programming it goes to low (Data=low to high and Data=high to low).

| | $I_{static_high} < I_{th_high_st}$ | $I_{static_high} > I_{th_high_st}$ |
|---|---|---|
| $I_{dyn_high} > I_{th_high_dyn}$ | ? | T2: OK |
| $I_{dyn_high} < I_{th_high_dyn}$ | T2: open | T2: short |

$I_{th_high_dyn}$ is the highest acceptable current for data high with dynamic programming.
$I_{th_high_low}$ is the highest acceptable current for data high with static programming.

One can also use the following pattern:

Static: WR is high (Data=low and Data=high).

Dynamic: WR goes high and after programming it goes to low (Data=high to low).

FIG. 17 illustrates a pixel circuit for use in testing a full display. The following are some of the factory tests that can be carried out to identify defects in the display. A similar concept can be applied to different circuits, although the following tests are defined for the circuit shown in FIG. 17.

Test 3:

Measuring T1 and OLED current through monitor.

Condition 1: T1 is OK from the backplane test.

| | $I_{oled} > I_{oled_high}$ | $I_{oled} < I_{oled_low}$ | $I_{oled}$ is OK |
|---|---|---|---|
| $I_{tft} > I_{tft_high}$ | x | x | x |
| $I_{tft} < I_{tft_low}$ | OLED: short | OLED: open<br>‖ T3: open | OLED: open |
| $I_{tft}$ is OK | x | OLED: open | OLED: ok |

$I_{tft_high}$ is the highest possible current for TFT current for a specific data value.
$I_{tft_high}$ is the lowest possible current for TFT current for a specific data value.
$I_{oled_high}$ is the highest possible current for OLED current for a specific OLED voltage.
$I_{oled_low}$ is the lowest possible current for OLED current for a specific OLED voltage.

Test 4:

Measuring T1 and OLED current through monitor

Condition 2: T1 is open from the backplane test

| | $I_{oled} > I_{oled_low}$ | $I_{oled} < I_{oled_low}$ | $I_{oled}$ is OK |
|---|---|---|---|
| $I_{tft} > I_{tft_high}$ | X | X | X |
| $I_{tft} < I_{tft_low}$ | OLED: short | OLED: open<br>‖ T3: open | OLED: open |
| $I_{tft}$ is OK | x | x | x |

Test 5:

Measuring T1 and OLED current through monitor

Condition 3: T1 is short from the backplane test

| | $I_{oled} > I_{oled_high}$ | $I_{oled} < I_{oled_low}$ | $I_{oled\ is\ OK}$ |
|---|---|---|---|
| $I_{tft} > I_{tft\ high}$ | X | X | X |
| $I_{tft} < I_{tft_low}$ | OLED: short | OLED: open<br>‖ T3: open | OLED: open |
| $I_{tft}$ is OK | x | x | x |

To compensate for defects that are darker than the sounding pixels, one can use surrounding pixels to provide the extra brightness required for the video/images. There are different methods to provide this extra brightness, as follows:

1. Using all immediate surrounding pixels and divide the extra brightness between each of them. The challenge with this method is that in most of the cases, the portion of assigned to each pixel will not be generated by that pixel accurately. Since the error generated by each surrounding pixel will be added to the total error, the error will be very large reducing the effectiveness of the correction.
2. Using on pixel (or two) of the surrounding pixels generate the extra brightness required by defective pixel. In this case, one can switch the position of the active pixels in compensation so that minimize the localized artifact.

During the lifetime of the display, some soft defects can create stock on (always bright) pixels which tends to be very annoying for the user. The real-time measurement of the panel can identify the newly generated stock on pixel. One can use extra voltage through monitor line and kill the OLED to turn it to dark pixel. Also, using the compensation method describe in the above, it can reduce the visual effect of the dark pixels.

Figure 18A:
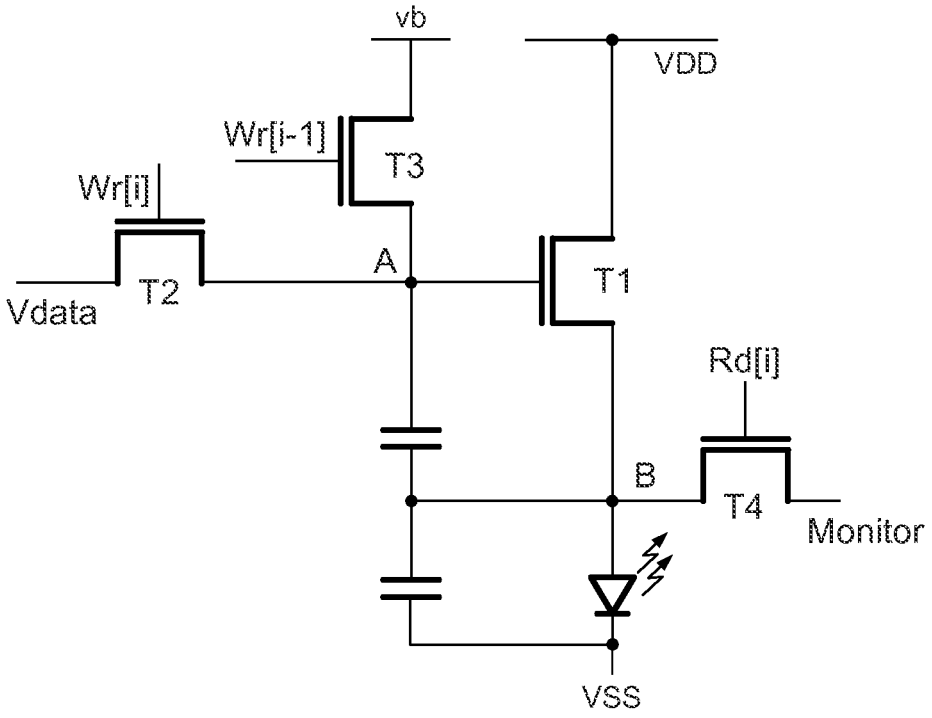
FIG. 18A is a circuit diagram of an exemplary driving circuit for a pixel that includes a monitor line coupled to a node B by a transistor T4 controlled by a Rd(i) line, for reading the current values of operating parameters such as the drive current and the OLED voltage.

FIG. 18A is a circuit diagram of an exemplary driving circuit for a pixel that includes a monitor line coupled to a node B by a transistor T4 controlled by a Rd(i) line, for reading the current values of operating parameters such as the drive current and the OLED voltage. The circuit of FIG. 18A also includes a transistor T2 for controlling the application of the programming signal Vdata to a node A, and a transistor T3 for controlling the application of a voltage Vb to the gate of the drive transistor T1 at node A.

Figure 18B:
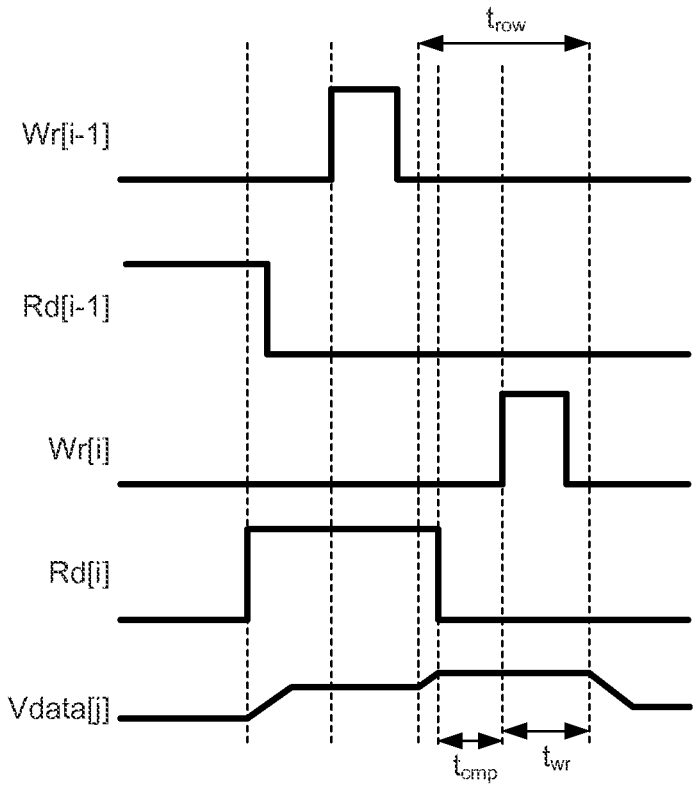
FIG. 18B is a timing diagram of a first exemplary programming operation for the pixel circuit shown in FIG. 18A.

FIG. 18B is a timing diagram of a first exemplary programming operation for the pixel circuit shown in FIG. 18A. Initially, the signals Wr[i−1] and Rd[i] are enabled to turn on the transistors T3 and T4, respectively. The signal Wr[i−1] can be the write signal of the previous row or a separate signal, and the signal Rd[i] can be enabled before the signal Wr[i−1] is enabled, to make sure the node B is reset properly. When the two signals Wr[i−1] and Rd[i] turn off (there is gap between the two signal to reduce the dynamic effects), the node B will start to charge up during the compensation time (tcmp). The charging is a function of the characteristics of the drive transistor T1. During this time, the Vdata input is charged to the programming voltage required for the pixel. The signal Wr[i] is enabled for a short time to charge the node A to the programming voltage.

Figure 18C:
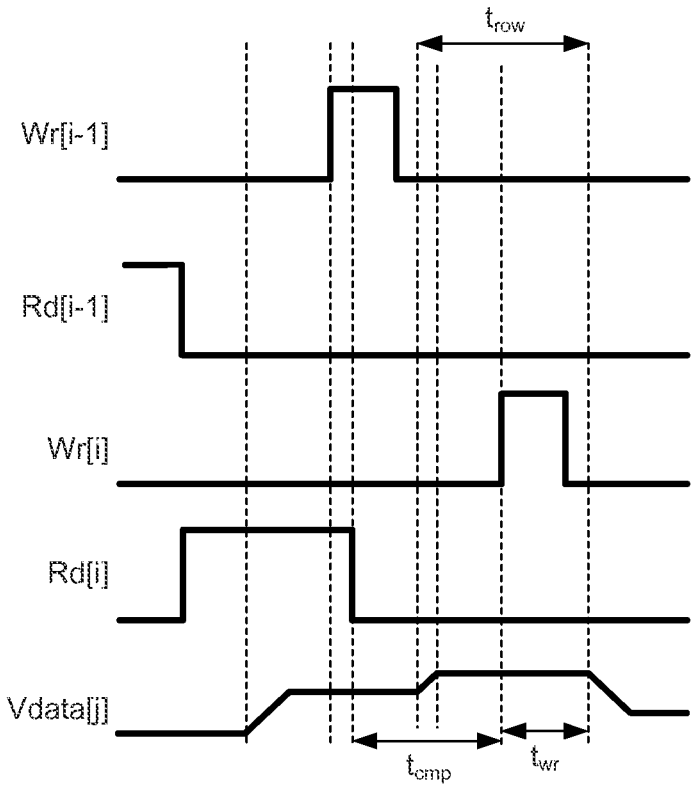
FIG. 18C is a timing diagram for a second exemplary programming operation for the pixel circuit of FIG. 18A.

FIG. 18C is a timing diagram for a second exemplary programming operation for the pixel circuit of FIG. 18A. Initially, the signal Rd[i] is enabled long enough to ensure that the node B is reset properly. The signal Rd[i] then turns off, and the signal Wr[i−1] turns on. The signal Wr[i−1] can be the write signal of the previous row or a separate signal. The overlap between two signals can reduce the transition error. A first mode of compensation then starts, with node B being charged via the drive transistor T1. The charging is a function of the characteristics of the transistor T1. When the signal Wr[i−1] turns off, the node B continues to charge during a second compensation interval tcmp. The charging is again a function of the characteristics of the transistor T1. If the gate-source voltage of the transistor T1 is set to its threshold voltage during the first compensation interval, there is no significant change during the second compensation interval. During this time, the Vdata input is charged to the programming voltage required for the pixel. The signal Wr[i] is enabled for short time to charge the node A to the programming voltage.

After a programming operation, the drive transistor and the OLED can be measured through the transistor T4, in the same manner described above for other circuits.

Figure 19A:
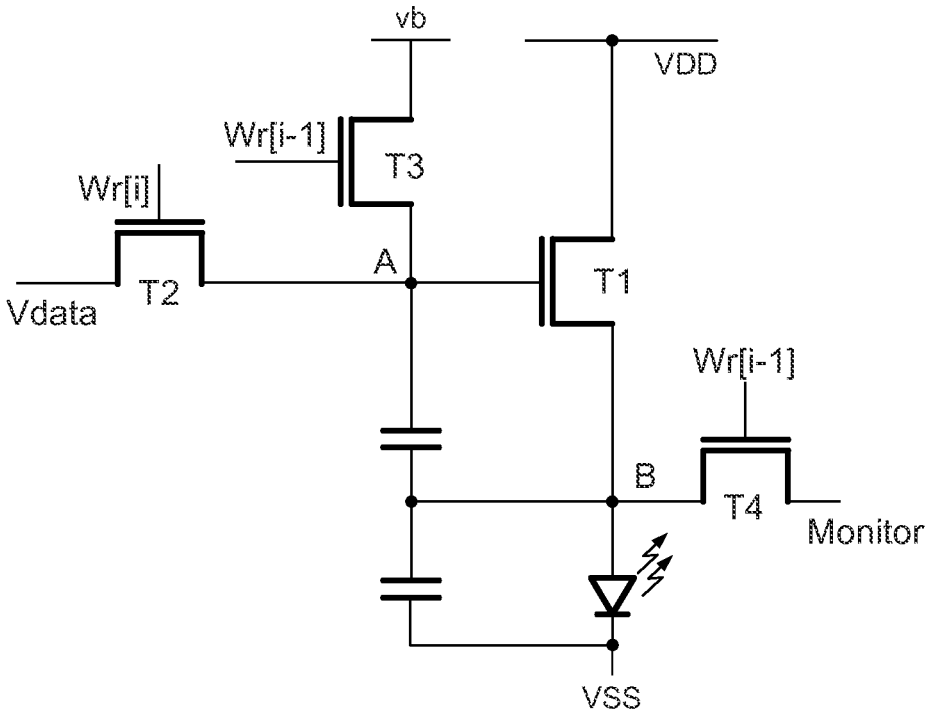
FIG. 19A is a circuit diagram of an exemplary driving circuit for another pixel that includes a monitor line.

FIG. 19A is a circuit diagram of an exemplary driving circuit for another pixel that includes a monitor line. In this case, the monitor line is coupled to the node B by a transistor T4 that is controlled by a Wr(i−1) line, for reading the current values of operating parameters such as the drive current and the OLED voltage. The circuit of FIG. 19A also includes a transistor T2 for controlling the application of the programming signal Vdata to a node A, and a transistor T3 for controlling the application of a reset voltage Vb to the gate of the drive transistor T1 at node A.

Figure 19B:
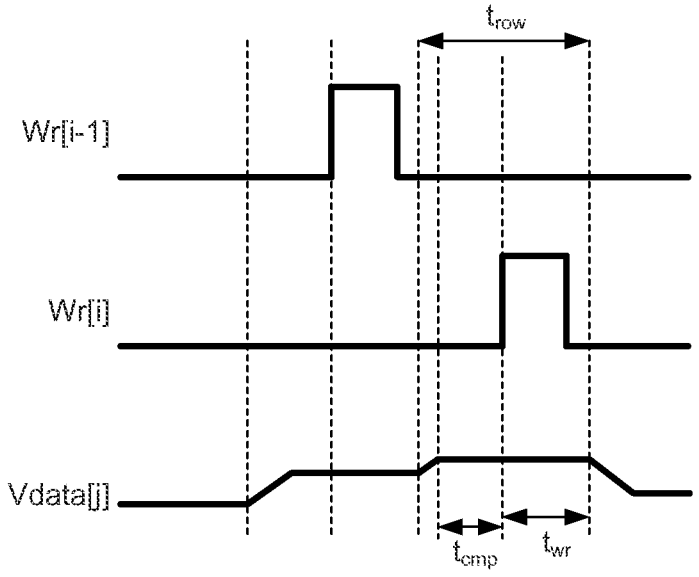
FIG. 19B is a timing diagram of a first exemplary programming operation for the pixel circuit shown in FIG. 19A.

FIG. 19B is a timing diagram of a first exemplary programming operation for the pixel circuit shown in FIG. 19A. This timing diagram is the same as the one illustrated in FIG. 18B except that the Rd signals are omitted.

Figure 20:
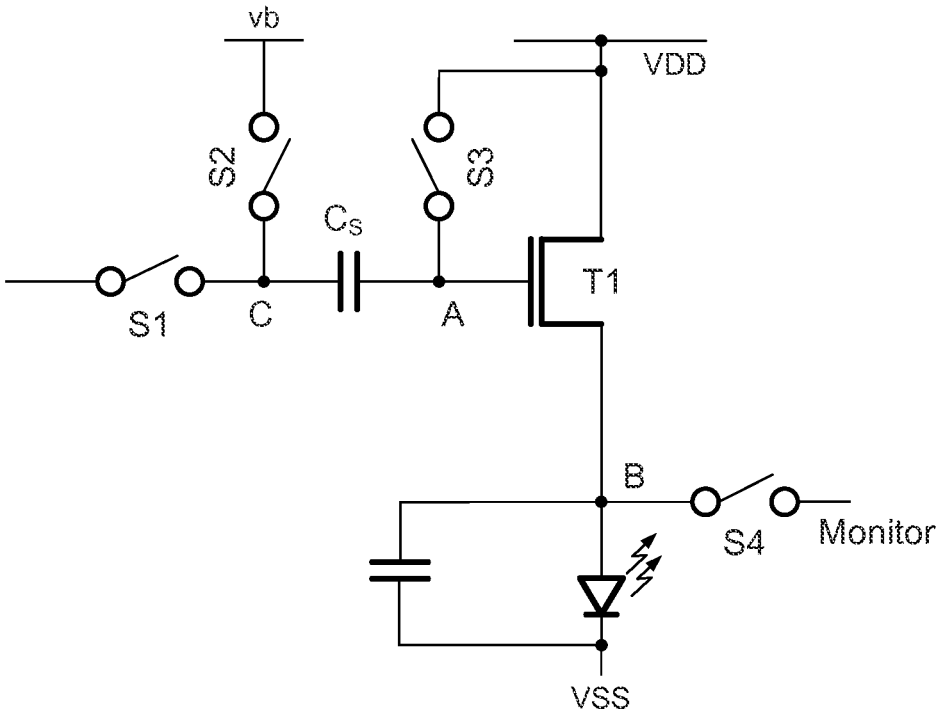
FIG. 20 is a circuit diagram of an exemplary driving circuit for yet another pixel that includes a monitor line.

FIG. 20 is a circuit diagram of an exemplary driving circuit for yet another pixel that includes a monitor line. In this case, the monitor line is coupled to the node B by a switch S4, for reading the current values of operating parameters such as the drive current and the OLED voltage. The circuit of FIG. 20 also includes a switch S1 for controlling the application of the programming signal Vdata to a node C, a switch S2 for controlling the application of a reset voltage Vb to the node C, and a switch S3 for connecting the gate of the drive transistor T1 to the drain of T1.

In an exemplary programming operation for the pixel circuit shown in FIG. 20, the switches S1 and S3 are initially enabled (closed) to charge the node C to programming data and to charge node A to Vdd. During a second phase, the switch S2 is enabled to charge the node C to Vb, and the other switches S1, S3 and S4 are disabled (open) so that the voltage at node A is the difference between Vb and the programming data. Since Vdd is sampled by the storage capacitor Cs during the first phase, the pixel current will be independent of Vdd changes. The voltage Vb and Mthe monitor line can be the same. In a measuring phase, the switch S4 can be used for measuring the drive current and the OLED voltage by closing the switch S4 to connect the monitor line to node B While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A display system comprising:

a supply voltage source;

a plurality of pixels, including at least one pixel circuit including:

a light-emitting device, a drive transistor for driving current through the light-emitting device according to a driving voltage across the drive transistor during an emission cycle, and a storage capacitor having a first terminal and a second terminal and for storing a voltage to be applied to the drive transistor during the emission cycle; and a controller configured to:

during a first operation cycle, couple the storage capacitor to the supply voltage source; and during a second operation cycle different from the first operation cycle, decouple the storage capacitor from the supply voltage source.

2. The display system of claim 1, wherein the first operation cycle occurs prior to the second operation cycle.

3. The display system of claim 1, wherein the first operation cycle occurs subsequent to the second operation cycle.

4. The display system of claim 1, wherein the controller is further configured to:

during the first operation cycle, decouple one of the first and second terminals of the storage capacitor from any voltage source allowing its voltage to float; and during the second operation cycle, couple the first and second terminals of the storage capacitor to two different voltage sources.

5. The display system of claim 1, wherein the controller is further configured to:

during the first operation cycle, couple the first and second terminals of the storage capacitor to two different voltage sources; and during the second operation cycle, decouple one of the first and second terminals of the storage capacitor from any voltage source allowing its voltage to float.

6. The display system of claim 4, wherein the first operation cycle occurs subsequent to the second operation cycle, wherein the controller is further configured to:

during the first operation cycle, couple the other of the first and second terminals of the storage capacitor to the supply voltage source; and during the second operation cycle, couple the first terminal of the storage capacitor to a data voltage source via a data line while coupling the second terminal of the storage capacitor to a predetermined voltage source.

7. The display system of claim 6, wherein the predetermined voltage source is a reference voltage source.

8. The display system of claim 5, wherein the first operation cycle occurs prior to the second operation cycle, wherein the controller is further configured to:

during the first operation cycle, couple the first terminal of the storage capacitor to the supply voltage source while coupling the second terminal of the storage capacitor to a data voltage source via a data line; and during the second operation cycle, couple the other of the first and second terminals of the storage capacitor to a predetermined voltage source.

9. The display system of claim 8, wherein the predetermined voltage source is a reset voltage source.

10. A display system comprising:

a supply voltage source;

a plurality of pixels, each pixel comprising a pixel circuit including:

a light-emitting device, a drive transistor for, during an emission cycle, driving current through the light-emitting device according to a driving voltage across the drive transistor, a storage capacitor for storing a voltage to be applied to the drive transistor during the emission cycle; and a controller configured to:

couple the supply voltage source to the storage capacitor and decouple the supply voltage source from the storage capacitor such that the driving current is independent of changes in a supply voltage of the supply voltage source.

11. A method of controlling a display system including a supply voltage source and a plurality of pixels including at least one pixel circuit including a light-emitting device, a drive transistor for driving current through the light-emitting device according to a driving voltage across the drive transistor during an emission cycle, and a storage capacitor having a first terminal and a second terminal and for storing a voltage to be applied to the drive transistor during the emission cycle, the method comprising:

during a first operation cycle, coupling the storage capacitor to the supply voltage source; and during a second operation cycle different from the first operation cycle, decoupling the storage capacitor from the supply voltage source.

12. The method of claim 11, wherein the first operation cycle occurs prior to the second operation cycle.

13. The method of claim 11, wherein the first operation cycle occurs subsequent to the second operation cycle.

14. The method of claim 11, comprising:

during the first operation cycle, decoupling one of the first and second terminals of the storage capacitor from any voltage source allowing its voltage to float; and during the second operation cycle, coupling the first and second terminals of the storage capacitor to two different voltage sources.

15. The method of claim 11, comprising:

during the first operation cycle, coupling the first and second terminals of the storage capacitor to two different voltage sources; and during the second operation cycle, decoupling one of the first and second terminals of the storage capacitor from any voltage source allowing its voltage to float.

16. The method of claim 14, wherein the first operation cycle occurs subsequent to the second operation cycle, the method comprising:

during the first operation cycle, coupling the other of the first and second terminals of the storage capacitor to the supply voltage source; and during the second operation cycle, coupling the first terminal of the storage capacitor to a data voltage source via a data line while coupling the second terminal of the storage capacitor to a predetermined voltage source.

17. The method of claim 16, wherein the predetermined voltage source is a reference voltage source.

18. The method of claim 15, wherein the first operation cycle occurs prior to the second operation cycle, the method comprising:

during the first operation cycle, coupling the first terminal of the storage capacitor to the supply voltage source while coupling the second terminal of the storage capacitor to a data voltage source via a data line; and during the second operation cycle, coupling the other of the first and second terminals of the storage capacitor to a predetermined voltage source.

19. The method of claim 18, wherein the predetermined voltage source is a reset voltage source.

20. A method of controlling a display system including a supply voltage source and a plurality of pixels including at least one pixel circuit including a light-emitting device, a drive transistor for, during an emission cycle, driving current through the light-emitting device according to a driving voltage across the drive transistor, and a storage capacitor for storing a voltage to be applied to the drive transistor during the emission cycle, the method comprising:

coupling the supply voltage source to the storage capacitor and decoupling the supply voltage source from the storage capacitor such that the driving current is independent of changes in a supply voltage of the supply voltage source.

* * * * *